US009404313B2

(12) United States Patent
Hefner et al.

(10) Patent No.: US 9,404,313 B2
(45) Date of Patent: Aug. 2, 2016

(54) DRILLING TUBING CLEANING SYSTEM AND METHOD

(71) Applicants: Steve Hefner, Borger, TX (US); Deborah Hefner, Borger, TX (US)

(72) Inventors: Steve Hefner, Borger, TX (US); Deborah Hefner, Borger, TX (US)

( * ) Notice: Subject to any disclaimer, the term of this patent is extended or adjusted under 35 U.S.C. 154(b) by 516 days.

(21) Appl. No.: 13/802,696

(22) Filed: Mar. 13, 2013

(65) Prior Publication Data

US 2014/0262298 A1 Sep. 18, 2014

(51) Int. Cl.

| | |
|---|---|
| ***E21B 17/06*** | (2006.01) |
| ***E21B 17/00*** | (2006.01) |
| ***E21B 33/08*** | (2006.01) |
| ***B08B 9/023*** | (2006.01) |

(52) U.S. Cl.

CPC ..... *E21B 17/006* (2013.01); *B08B 9/023* (2013.01); *E21B 33/08* (2013.01)

(58) Field of Classification Search

CPC ..... E21B 19/00; E21B 37/00; B08B 9/023
See application file for complete search history.

(56) References Cited

U.S. PATENT DOCUMENTS

| | | | | |
|---|---|---|---|---|
| 3,820,184 | A | | 6/1974 | Stone |
| 4,205,694 | A | | 6/1980 | Thompson |
| 4,517,699 | A | | 5/1985 | Petricka |
| 4,723,564 | A | | 2/1988 | West |
| 4,895,205 | A | * | 1/1990 | Thompson et al. ..... 166/90.1 |
| 5,069,234 | A | | 12/1991 | Nielsen |
| 5,101,896 | A | | 4/1992 | Thompson |
| 5,136,969 | A | | 8/1992 | Chapman |
| 5,191,740 | A | | 3/1993 | Rose |
| 5,361,791 | A | | 11/1994 | Chapman |
| 5,526,877 | A | * | 6/1996 | Winz ..... 166/88.2 |
| 5,615,696 | A | | 4/1997 | Lawler |
| 5,647,906 | A | | 7/1997 | Monday |
| 5,802,667 | A | | 9/1998 | Williams |
| 5,946,757 | A | | 9/1999 | Oliveira |
| 6,941,613 | B2 | | 9/2005 | Bryant |
| 7,294,222 | B2 | | 11/2007 | Temple |
| 7,409,995 | B2 | | 8/2008 | Moynahan |
| 7,765,632 | B2 | | 8/2010 | Lawler |
| 2012/0305234 | A1 | * | 12/2012 | Vowels ..... 166/90.1 |
| 2014/0069896 | A1 | * | 3/2014 | Deutch et al. ..... 219/121.67 |

* cited by examiner

*Primary Examiner* — William P Neuder

(74) *Attorney, Agent, or Firm* — Shannon L Warren

(57) ABSTRACT

A tubing cleaning system comprising: a body portion, a tubing aperture, a one or more spray heads, a fluid input and a one or more fluid channels. Said body portion comprising a one or more plates. Said tubing aperture through said one or more plates. Said one or more spray heads arranged within said tubing aperture. Said fluid input. Said one or more fluid channels cut into said one or more plates between said fluid input and said one or more spray heads.

15 Claims, 20 Drawing Sheets

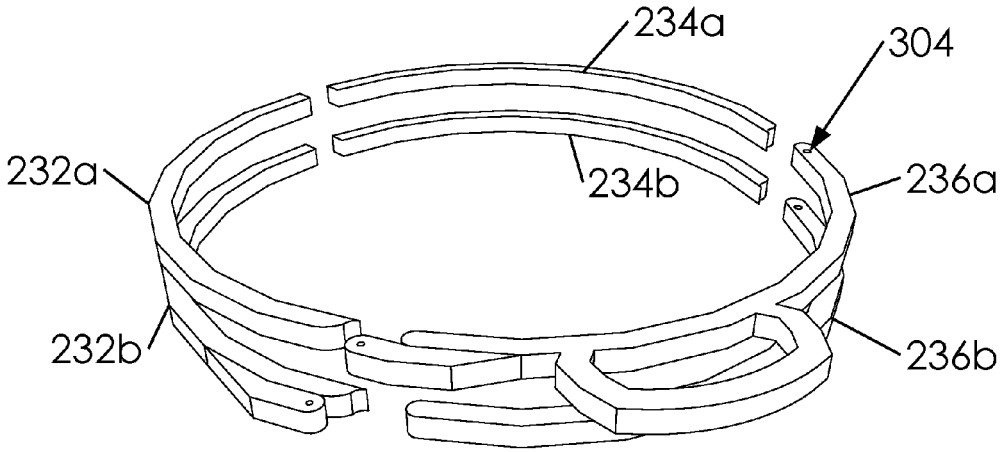
Fig. 5A
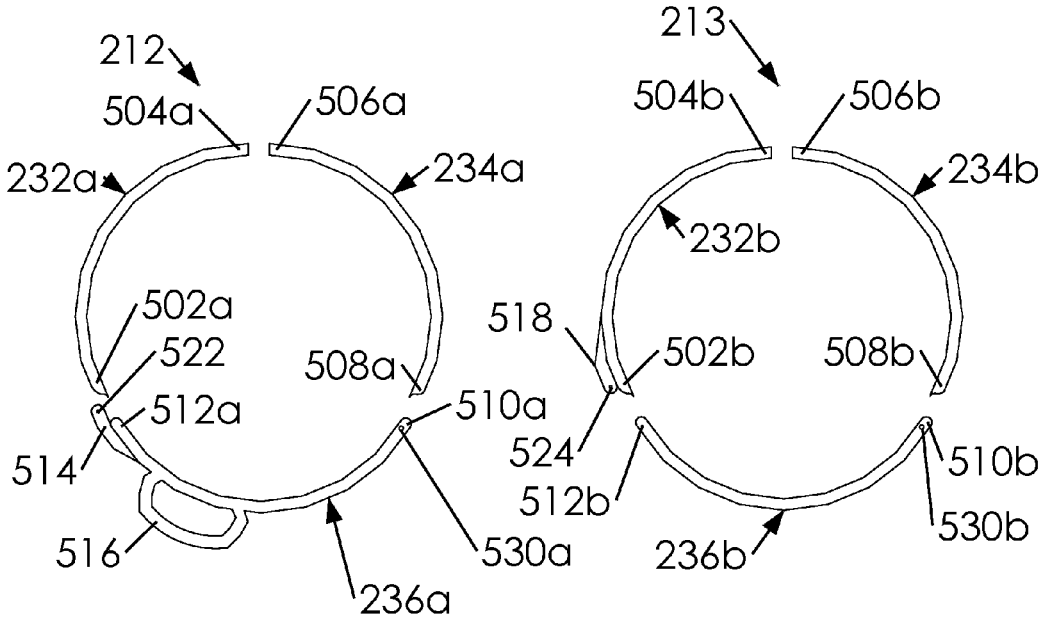
Fig. 5B
Fig. 5C

DRILLING TUBING CLEANING SYSTEM AND METHOD

SUMMARY

A tubing cleaning system and method of use thereof are disclosed.

Said tubing cleaning system comprising: a bod portion, a tubing aperture, a one or more spray heads, a fluid input and a one or more fluid channels. Said body portion comprising a one or more plates. Said tubing aperture through said one or more plates. Said one or more spray heads arranged within said tubing aperture. Said fluid input. Said one or more fluid channels cut into said one or more plates between said fluid input and said one or more spray heads.

Said method of using a tubing cleaning system comprising: attaching said tubing cleaning system having a tubing aperture to a portion of a tubing removal assembly at a wellhead; removing a portion of a tubing from a casing at said wellhead and sliding said portion of said tubing through said tubing aperture; attaching a hose to said tubing cleaning system; supplying a fluid to said tubing cleaning system through said hose; channeling said fluid through a one or more fluid channels within said tubing cleaning system; spraying a fluid at said tubing with a one or more spray heads; and supporting a one or more forces pressing into said tubing cleaning system. Said tubing cleaning system comprises a body portion comprising a one or more plates, said tubing aperture through said one or more plates, said one or more spray heads arranged within said tubing aperture, a fluid input, and said one or more fluid channels cut into said one or more plates between said fluid input and said one or more spray heads.

BACKGROUND

This disclosure relates generally to a tubing cleaning system and method of use. Examples of tubing cleaning systems can be found in U.S. Pat. No. 7,409,995 and as disclosed with this application. However, none of the disclosed inventions and patents, taken either singularly or in combination, is seen to describe the instant disclosure as claimed. Accordingly, an improved tubing cleaning system and method of use would be advantageous.

BRIEF DESCRIPTION OF THE DRAWINGS

FIGS. 5A, 5B and 5C illustrate an exploded overview of said one or more spacers, an exploded elevated top view of said first spacer assembly and an exploded elevated top view of said second spacer assembly.

DETAILED DESCRIPTION

Figure 1A:
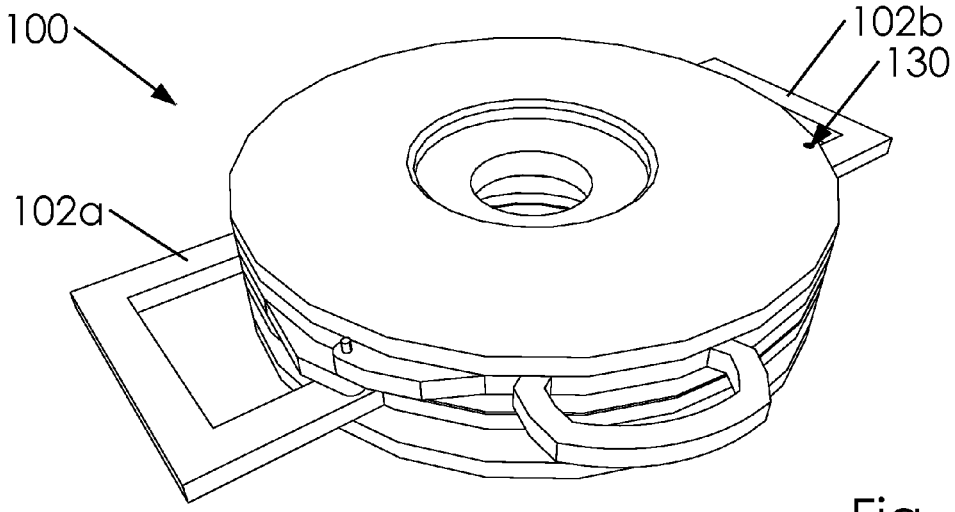
FIGS. 1A, 1B, 1C and 1D illustrate a perspective overview, an elevated back view, an elevated top view and an elevated front side view of a tubing cleaning system.
Figure 1B:
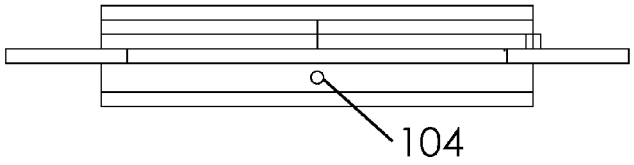
Figure 1C:
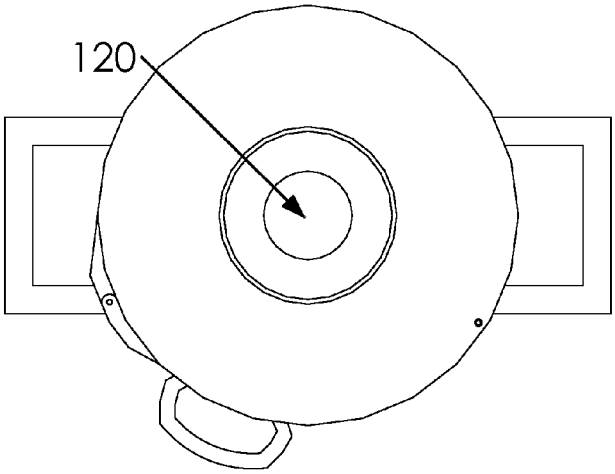
Figure 1D:
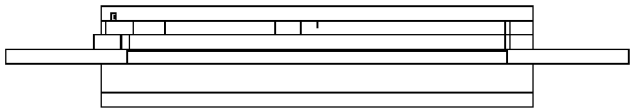

Described herein is a tubing cleaning system and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

FIGS. 1A, 1B, 1C and 1D illustrate a perspective overview, an elevated back view, an elevated top view and an elevated front side view of a tubing cleaning system 100. In one embodiment, said tubing cleaning system 100 can comprise a one or more plates, a one or more handles, a fluid input 104, a one or more spray heads (not illustrated here, see below), and a tubing aperture 120. In one embodiment, said one or more handles can comprise a first handle 102*a* and a second handle 102*b*. In one embodiment, said one or more plates can be attached to one another to form a body portion of said tubing cleaning system 100. In one embodiment, said tubing cleaning system 100 can be substantially symmetrical and said tubing aperture 120 can comprise a vertical hole through a center portion of said tubing cleaning system 100. In one embodiment, a portion of a tubing can be pulled or pushed through said tubing aperture 120. In one embodiment, one or more of said one or more spray heads can spray a fluid within said tubing aperture 120. In one embodiment, said tubing cleaning system 100 can receive said fluid through said fluid input 104, channel said fluid to said one or more spray heads and spray said fluid within said tubing aperture 120. In one embodiment, said tubing cleaning system 100 can comprise a hinge socket 130 capable of receiving a hinge pin 216 (described below, not illustrated here).

Figure 2:
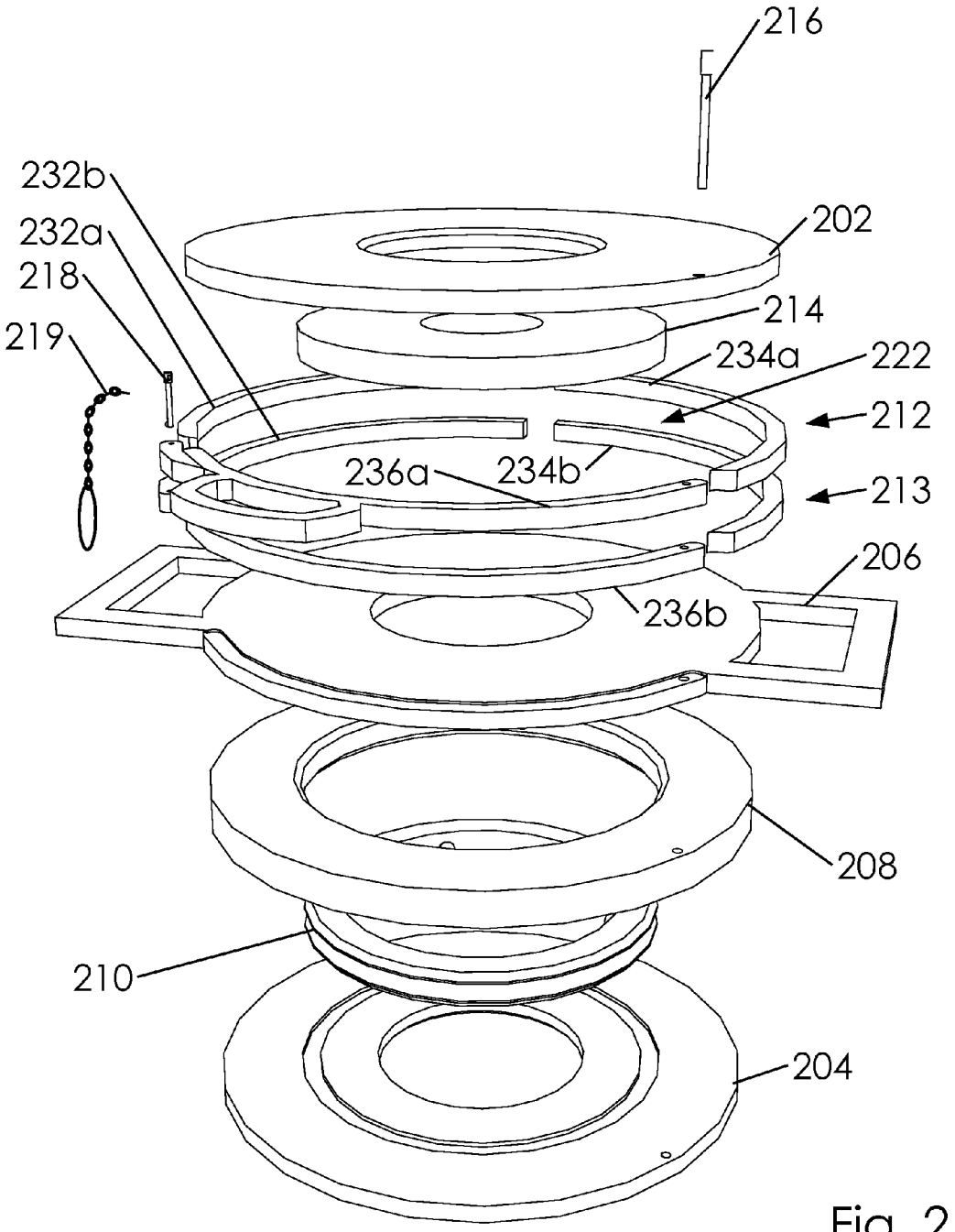
FIG. 2 illustrates an exploded perspective overview of said tubing cleaning system.

FIG. 2 illustrates an exploded perspective overview of said tubing cleaning system 100. In one embodiment, said tubing cleaning system 100 can comprise said one or more plates. In one embodiment, said one or more plates can comprise a first outer plate 202, a second outer plate 204, a handle plate 206, a first pressure ring 208 and a second pressure ring 210. In one embodiment, said one or more plates of said tubing cleaning system 100 can further comprise a one or more spacers. In one embodiment, said one or more spacers can comprise a first spacer assembly 212, a second spacer assembly 213. In one embodiment, said tubing cleaning system 100 can comprise a wiping rubber 214, said hinge pin 216 and a pin 218. In one embodiment, said one or more plates (with said one or more spacers) can comprise an aperture capable of receiving said hinge pin 216. In one embodiment, said hinge pin 216 can comprise a roll pin; wherein, said hinge pin 216 does not comprise a threading, although threading is not explicitly disclaimed. In one embodiment, said pin 218 can attach to a chain 219, and said chain 219 can attach to a portion of said handle plate 206 (as will be discussed below). In one embodiment, said tubing cleaning system 100 can comprise a cavity 222 between said first outer plate 202, said handle plate 206 and within said first spacer assembly 212 and said second spacer assembly 213; wherein, said cavity 222 can house said wiping rubber 214. In one embodiment, said one or more plates, said wiping rubber 214, said first spacer assembly 212, said second spacer assembly 213 can each comprise an aperture matching said tubing aperture 120.

In one embodiment, said first spacer assembly 212 can comprise a first spacer 232*a*, a second spacer 234*a* and an arm spacer 236*a*. In one embodiment, said second spacer assembly 213 can comprise a first spacer 232*b*, a second spacer 234*b* and an arm spacer 236*b*.

Figure 3A:
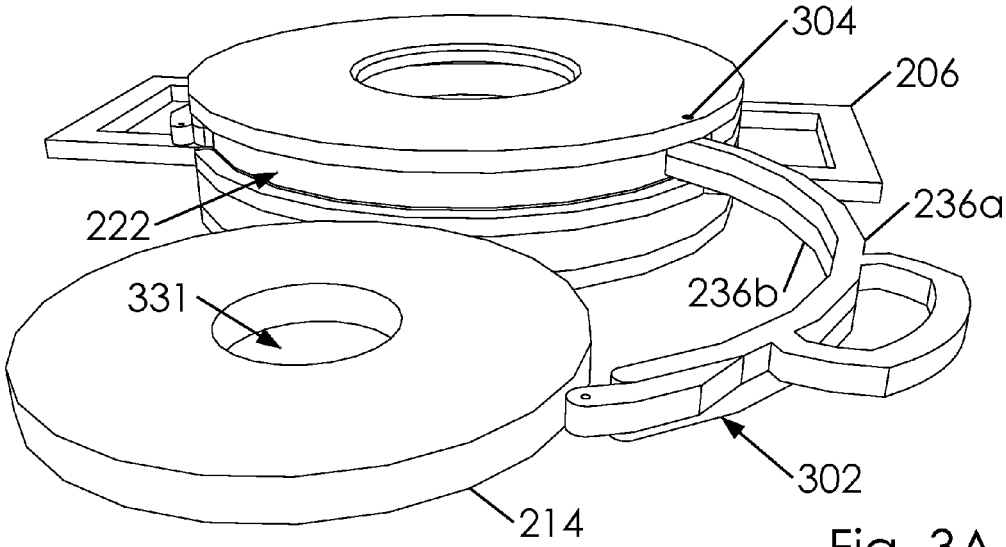
FIGS. 3A, 3B and 3C illustrate a perspective overview of said tubing cleaning system with said wiping rubber and a gate in an open-configuration; said tubing cleaning system without said first outer plate; and an elevated cross-section view of said one or more spacers with said wiping rubber.
Figure 3B:
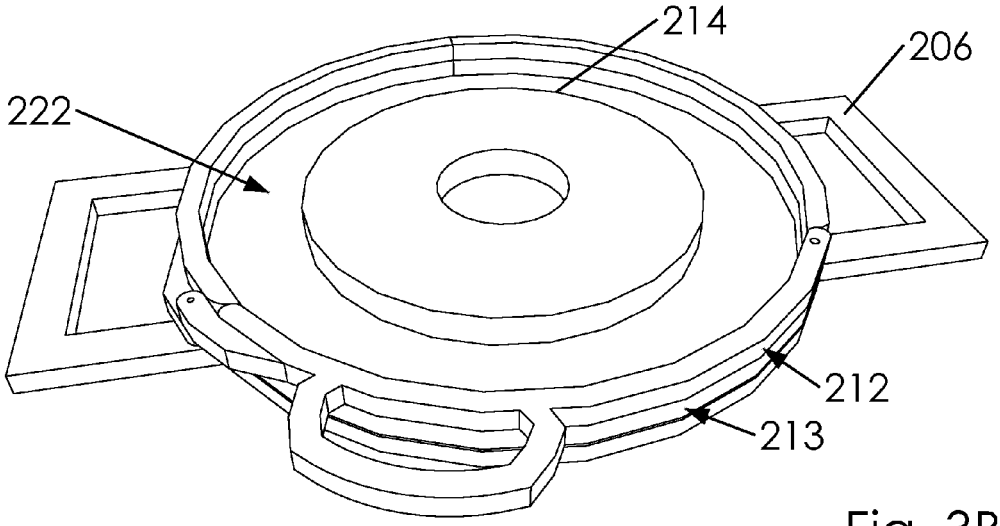
Figure 3C:
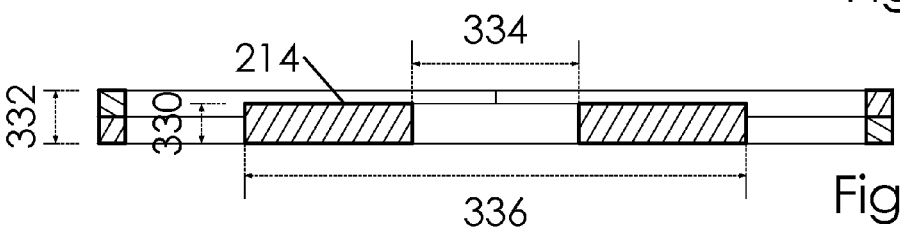
Figure 4A:
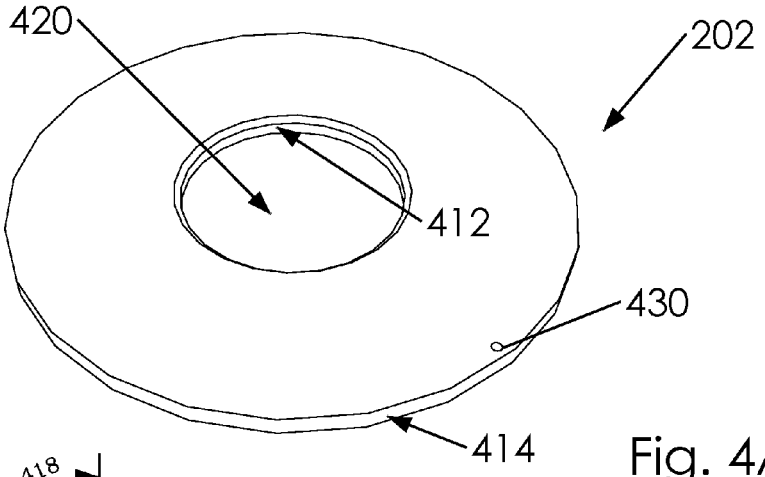
FIGS. 4A, 4B, 4C and 4D illustrate a perspective overview, an elevated cross-section side view, an elevated top view and an elevated side view of said first outer plate.
Figure 4B:
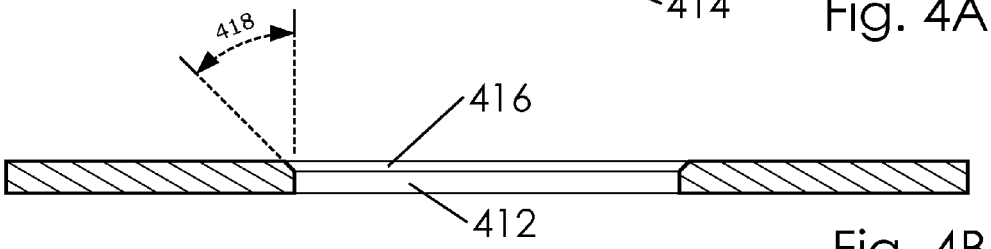
Figure 4C:
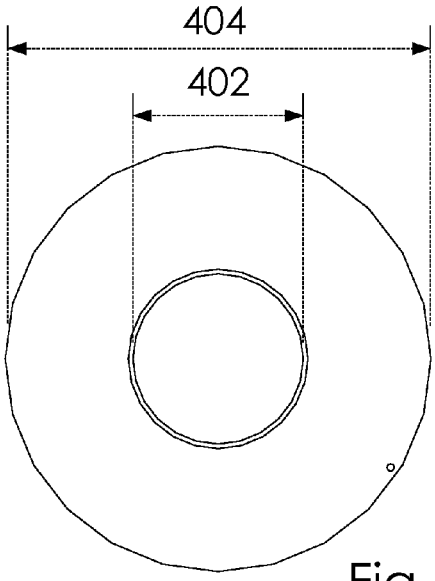
Figure 4D:
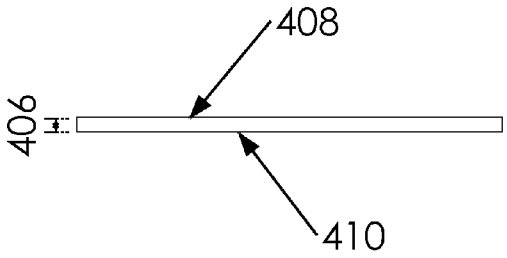
Figure 6A:
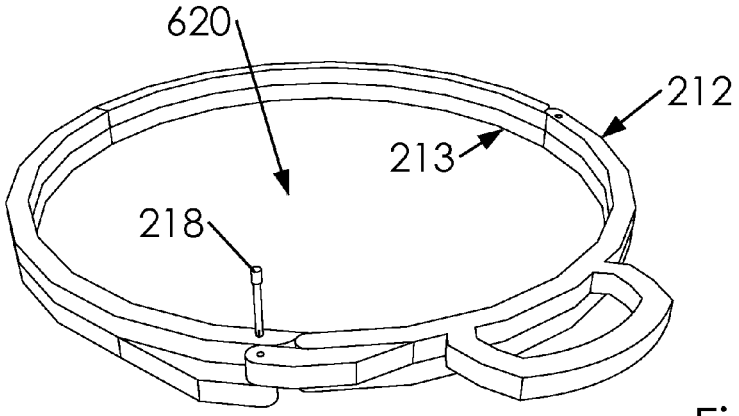
FIGS. 6A, 6B, 6C and 6D illustrate an overview, an elevated top view, an elevated side view and a perspective detail view of said one or more spacers and said pin.
Figure 6B:
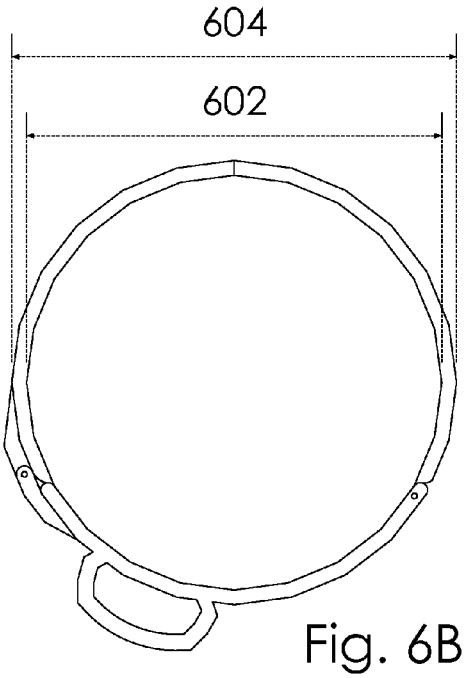
Figure 6C:
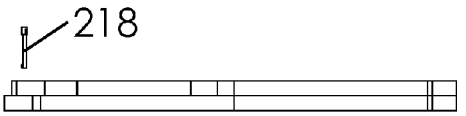
Figure 6D:
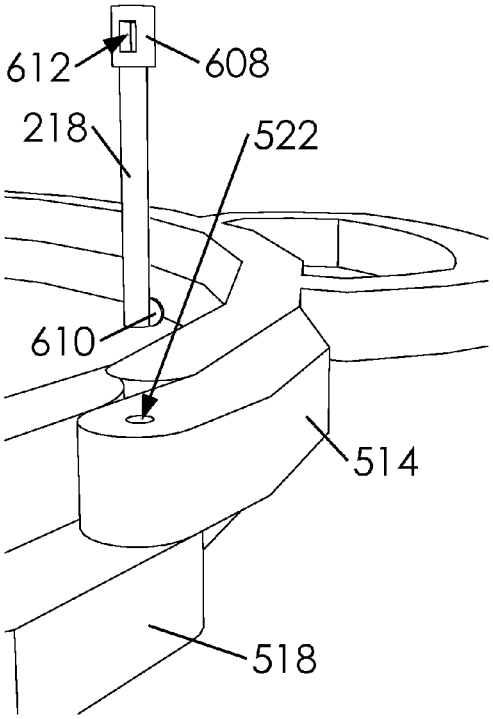
Figure 7A:
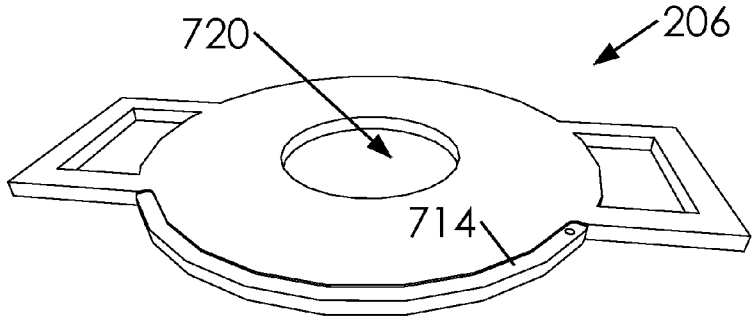
FIGS. 7A, 7B, 7C and 7D illustrate a perspective overview, a perspective bottom side view, an elevated top view and an elevated side view of said handle plate.
Figure 7B:
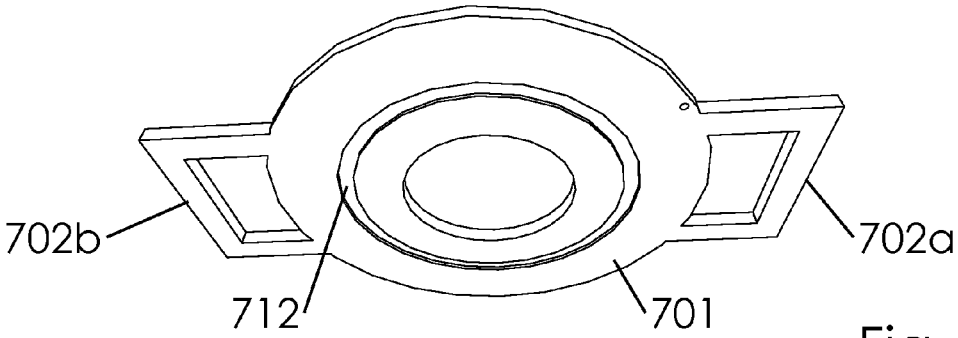
Figure 7C:
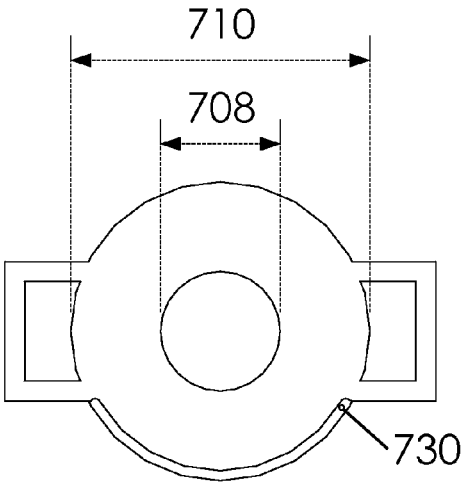
Figure 7D:
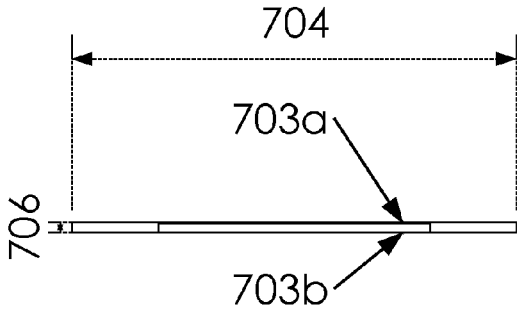

FIGS. 3A, 3B and 3C illustrate a perspective overview of said tubing cleaning system 100 with said wiping rubber 214 and a gate 302 in an open-configuration; said tubing cleaning system 100 without said first outer plate 202; and an elevated cross-section view of said one or more spacers with said wiping rubber 214. In one embodiment, said gate 302 can comprise said arm spacer 236*a* and said arm spacer 236*b*. In one embodiment, said gate 302 can comprise a hinge 304 comprising a portion of said hinge pin 216. In one embodiment, said gate 302 can pivot upon said hinge 304 to between an open-configuration (as in FIG. 3A) and a closed-configuration (as in FIG. 3B).

In one embodiment, said wiping rubber 214 can comprise a substantially round shape with a tubing aperture 331 about its center portion. In one embodiment, said wiping rubber 214 can comprise an external rim 324 and an internal rim 326. In one embodiment, said wiping rubber 214 can comprise a thickness 330 and said one or more spacers can comprise a thickness 332. In one embodiment, said thickness 330 can comprise ⅝". In one embodiment, said thickness 332 can comprise 1", with each of said first spacer assembly 212 and said second spacer assembly 213 being ½". Thus, in one embodiment, said wiping rubber 214 can move about freely within said cavity 222. In one embodiment, said wiping rubber 214 can comprise an internal diameter 334 at said internal rim 326 and an external diameter 336 at said external rim 324.

FIGS. 4A, 4B, 4C and 4D illustrate a perspective overview, an elevated cross-section side view, an elevated top view and an elevated side view of said first outer plate 202. In one embodiment, said first outer plate 202 can comprise an internal diameter 402, an external diameter 404, a thickness 406, a first face 408, a second face 410, an interior rim 412, an external rim 414, an aperture 420, and a hinge pin aperture 430. In one embodiment, said first outer plate 202 can be substantially round with said aperture 420 in a central portion of said first outer plate 202. In one embodiment, said internal diameter 402 can comprise 6". In one embodiment, said internal diameter 402 can comprise a diameter of said aperture 420. In one embodiment, said hinge pin aperture 430 can receive a portion of said hinge pin 216. In one embodiment, said first face 408 and said second face 410 can be substantially flat. In one embodiment, said interior rim 412 and said external rim 414 can be substantially cylindrical faces with said interior rim 412 being an interior face formed by cutting out a cylinder from said first outer plate 202 and said external rim 414 can comprise an exterior face of said cylindrical shape. In one embodiment, said interior rim 412 can comprise a beveled edge 416. In one embodiment, said beveled edge 416 can comprise an offset angle 418 between said first face 408 and said interior rim 412. In one embodiment, said offset angle 418 can comprise 45 degrees. In one embodiment, said beveled edge 416 can soften a portion of said tubing aperture 120 so as to prevent damage to objects passed through said tubing aperture 120.

FIGS. 5A, 5B and 5C illustrate an exploded overview of said one or more spacers, an exploded elevated top view of said first spacer assembly 212 and an exploded elevated top view of said second spacer assembly 213. In one embodiment, said first spacer 232*a* can comprise a first end 502*a* and a second end 504*a*; said second spacer 234*a* can comprise a first end 506*a* and a second end 508*a*; and said arm spacer 236*a* can comprise a first end 510*a* and a second end 512*a*. In one embodiment, said first spacer 232*b* can comprise a first end 502*b* and a second end 504*b*; said second spacer 234*b* can comprise a first end 506*b* and a second end 508*b*; and said arm spacer 236*b* can comprise a first end 510*b* and a second end 512*b*. In one embodiment, said arm spacer 236*a* can comprise a hinge pin aperture 530*a*, a first latch adapter 514 and a handle 516. In one embodiment, said first latch adapter 514 and said second latch adapter 518 can comprise a one or more latch adapters. In one embodiment, said first spacer 232*b* can comprise a second latch adapter 518. In one embodiment, said arm spacer 236*b* can comprise a hinge pin aperture 530*b*. In one embodiment, said one or more spacers can comprise a plurality of parts arranged about a circular path. For example, in one embodiment, said first spacer assembly 212 can comprise said second end 504*a* aligned with said first end 506*a*, said second end 508*a* aligned with said first end 510*a*, and said second end 512*a* aligned with said first end 502*a*; likewise, said first spacer 232*b*, second spacer 234*b* and said arm spacer 236*b* can be arranged in a similar manner. In one embodiment, said first latch adapter 514 and said second latch adapter 518 can be used to attach said gate 302 with a remaining portion of said one or more spacers (as will be discussed below). In one embodiment, said first latch adapter 514 can comprise a pin aperture 522. In one embodiment, said second latch adapter 518 can comprise a pin aperture 524.

FIGS. 6A, 6B, 6C and 6D illustrate an overview, an elevated top view, an elevated side view and a perspective detail view of said one or more spacers and said pin 218. In one embodiment, said one or more spacers can comprise an internal diameter 602 and an external diameter 604. In one embodiment, said pin 218 can comprise a cylindrical body with a head 608 at a first end and a fin 610 at another end. In one embodiment, said head 608 can comprise an aperture 612 capable of receiving a portion of said chain 219. In one embodiment, said one or more spacers can comprise a tubing aperture 620. In one embodiment, said tubing aperture 620 can comprise a portion of said tubing aperture 120. In one embodiment, locking said gate 302 in said closed-configuration can comprise: aligning said first latch adapter 514 with said second latch adapter 518; aligning said pin aperture 522 with said pin aperture 524 (not illustrated here); inserting said pin 218 into said pin aperture 522 and through said pin aperture 524; and holding said gate 302 in said closed-configuration.

FIGS. 7A, 7B, 7C and 7D illustrate a perspective overview, a perspective bottom side view, an elevated top view and an elevated side view of said handle plate 206. In one embodiment, said handle plate 206 can comprise a body portion 701, a first handle 702*a* and a second handle 702*b*. In one embodiment, said handle plate 206 can comprise a first face 703*a*, a second face 703*b*, a width 704 and a thickness 706. In one embodiment, said body portion 701 can comprise a substantially round portion of said handle plate 206 with a tubing aperture 720 about its central portion; wherein said handle plate 206 can comprise an internal diameter 708 and an external diameter 710. In one embodiment, said internal diameter 708 can comprise 6.25". In one embodiment, said second face 703*b* of said body portion 701 can comprise a weld gap 712. In one embodiment, said weld gap 712 can comprise a substantially round indention in said second face 703*b* around said tubing aperture 720. Said weld gap 712 will be discussed further below. In one embodiment, said first face 703*a* of said body portion 701 can comprise a gate gap 714. In one embodiment, said gate gap 714 can receive a portion of said gate 302 when said gate 302 is in said closed-configuration. In one embodiment, said gate gap 714 can comprise an indention in said first face 703*a* about a circumference of said body portion 701. In one embodiment, said body portion 701 can comprise a hinge pin aperture 730. In one embodiment, said hinge pin aperture 730 can penetrate through said handle plate 206.

Figure 8:
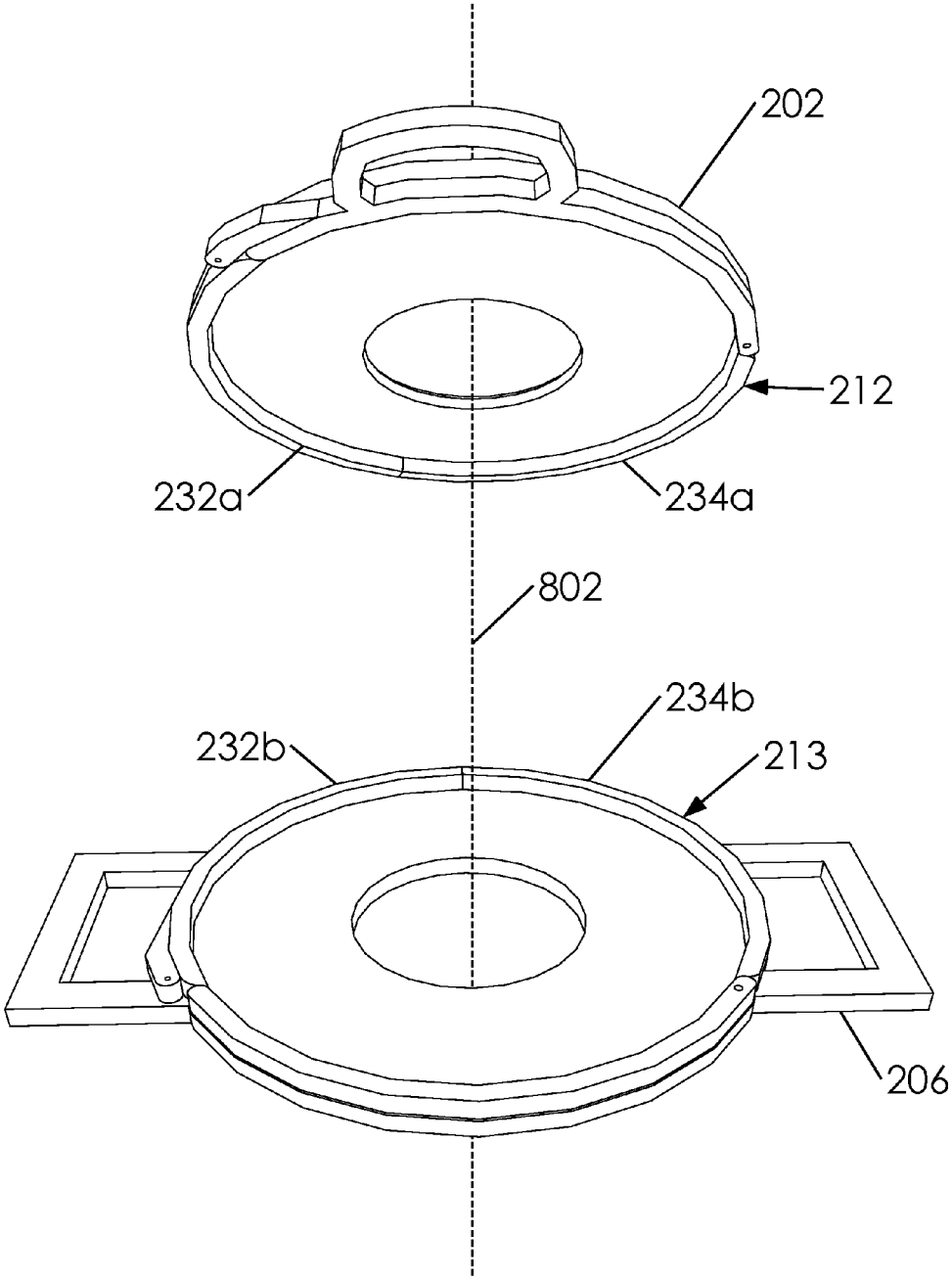
FIG. 8 illustrates said first outer plate with said first spacer assembly attached and said handle plate 206 with said second spacer assembly.
Figure 9A:
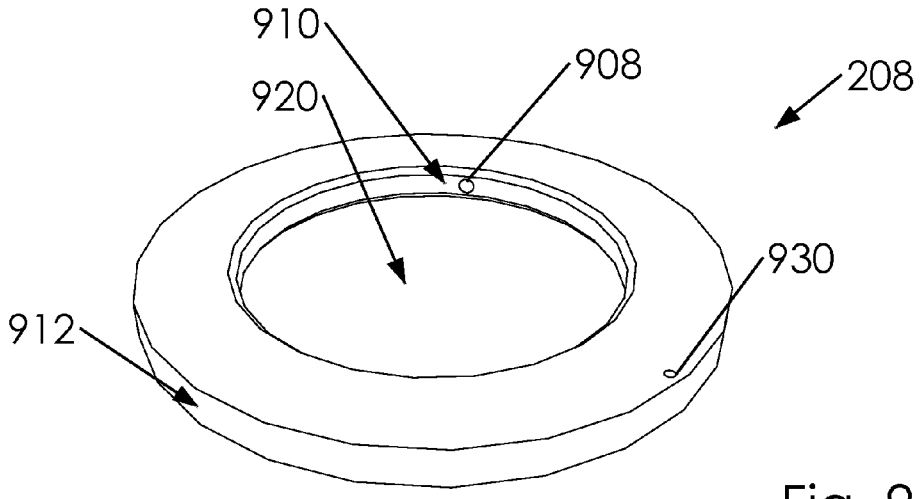
FIGS. 9A, 9B, 9C, 9D and 9E illustrate a perspective overview, an elevated top view, an elevated side view, an elevated cross-section view and an elevated top wireframe view of said first pressure ring.
Figure 9B:
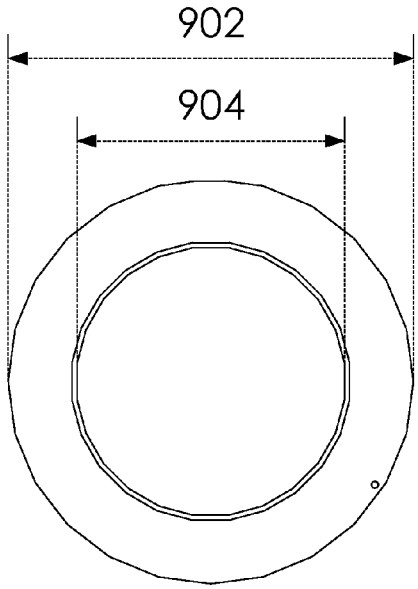
Figure 9D:
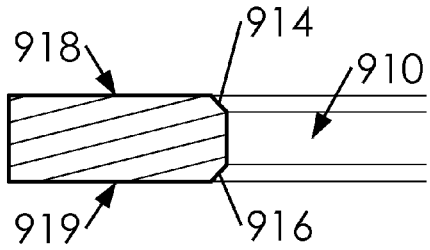
Figure 9C:
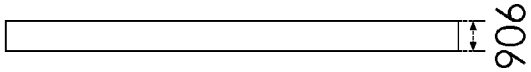
Figure 9E:
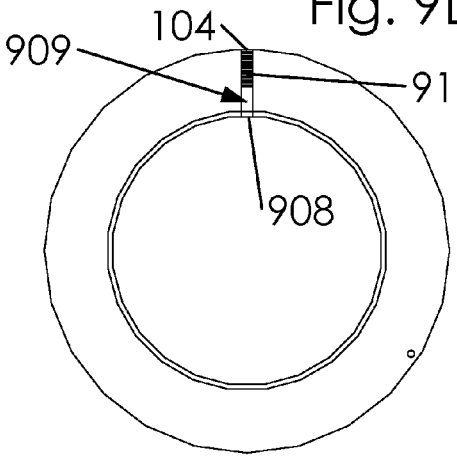
Figure 10A:
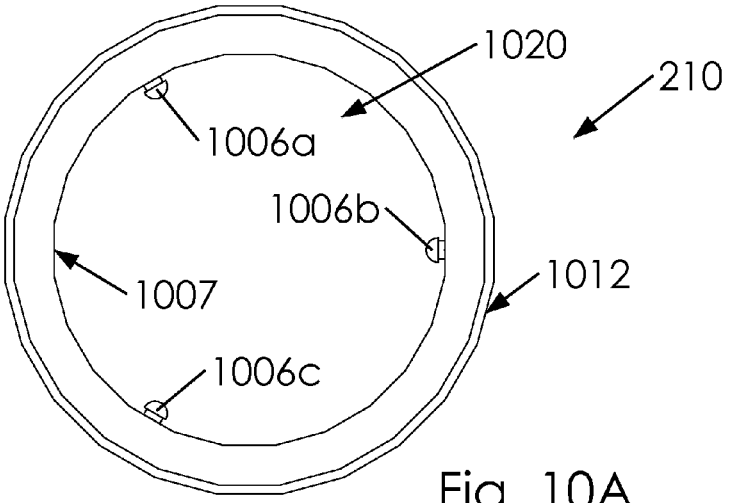
FIGS. 10A, 10B, 10C and 10D illustrate an elevated top view, an elevated side view, an elevated wireframe top view and an elevated detail side cross-section view of said second pressure ring.
Figure 10B:
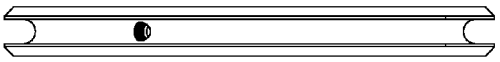
Figure 10C:
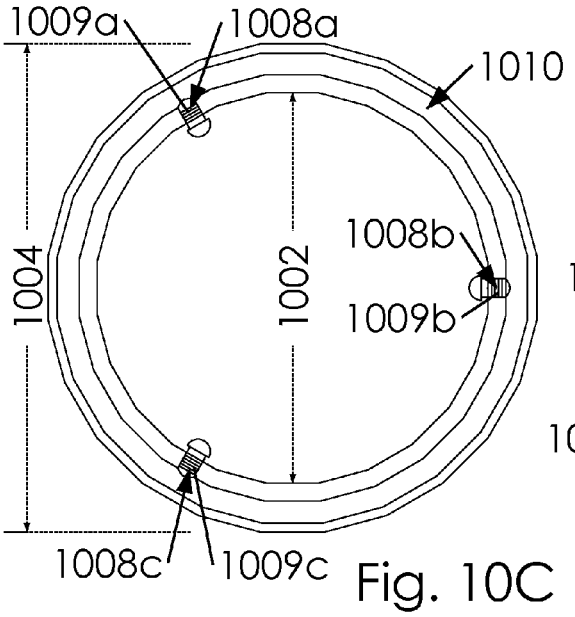
Figure 10D:
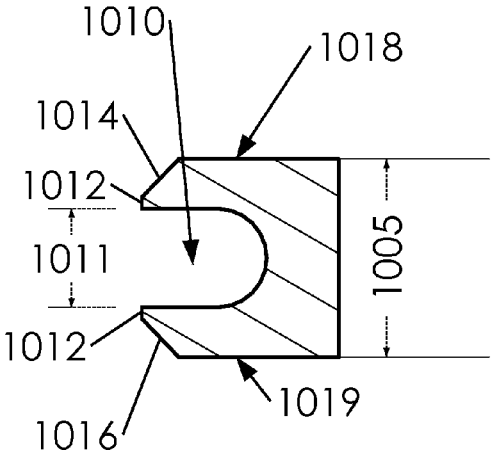
Figure 11A:
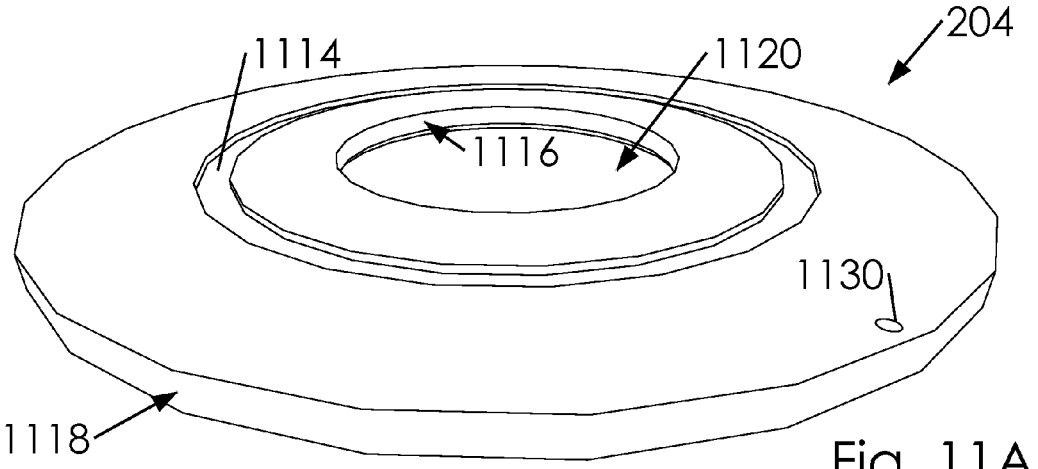
FIGS. 11A, 11B, 11C and 11D illustrate a perspective overview, an elevated top view, an elevated side view, and an elevated cross-section side view of said second outer plate.
Figure 11B:
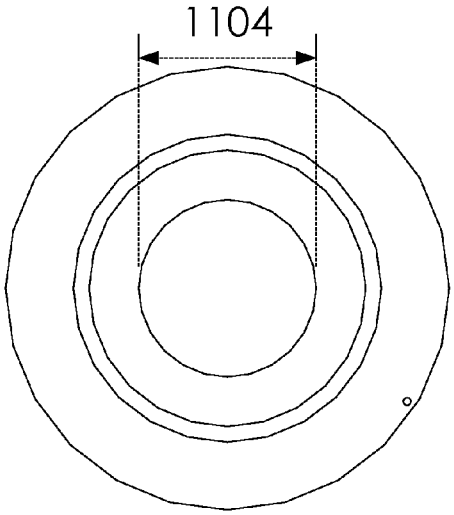
Figure 11D:
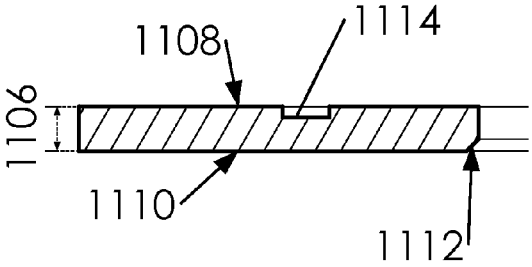
Figure 11C:
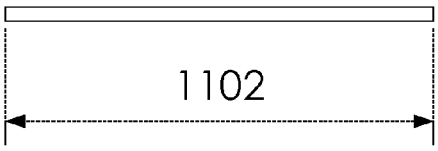

FIG. 8 illustrates said first outer plate 202 with said first spacer assembly 212 attached and said handle plate 206 with said second spacer assembly 213. In one embodiment, assembling said tubing cleaning system 100 can (in part) comprise: welding said first spacer assembly 212 to said first outer plate 202; welding said second spacer assembly 213 to said handle plate 206; and welding a portion of said first spacer assembly 212 to said second spacer assembly 213. In one embodiment, welding a portion of said first spacer assembly 212 to said second spacer assembly 213 can comprise: welding said first spacer 232*a* to said first spacer 232*b* and welding said second spacer 234*a* to said second spacer 234*b*. In one embodiment, said first spacer 232*a* can be welded to said second spacer 234*a* and said first spacer 232*b* can be welded to said second spacer 234*b*.

FIGS. 9A, 9B, 9C, 9D and 9E illustrate a perspective overview, an elevated top view, an elevated side view, an elevated cross-section view and an elevated top wireframe view of said first pressure ring 208. In one embodiment, said first pressure ring 208 can comprise a substantially round plate in a ring shape comprising an external diameter 902, an internal diameter 904 and a thickness 906. In one embodiment, said first pressure ring 208 can comprise said fluid input 104, a fluid output 908 and a fluid channel 909. In one embodiment, said fluid channel 909 can comprise an aperture in said first pressure ring 208 between said fluid input 104 and said fluid output 908. In one embodiment, said first pressure ring 208 can comprise an interior rim 910 about said internal diameter 904 and an external rim 912 about said external diameter 902. In one embodiment, said fluid channel 909 can comprise an internal threading 913. In one embodiment, a hose (having an external threading) can attach to said fluid input 104 by: aligning said hose with said fluid input 104, inserting a portion of said hose into said fluid input 104, screwing a portion of said hose into said fluid channel 909. In one embodiment, said fluid channel 909 can cut through said first pressure ring 208 between said external rim 912 and said interior rim 910. In one embodiment, said fluid input 104 can be in said external rim 912 and said fluid output 908 can be in said interior rim 910. In one embodiment, said interior rim 910 can comprise a first bevel 914 and a second bevel 916. In one embodiment, said first pressure ring 208 can comprise a first face 918 and a second face 919. In one embodiment, said first bevel 914 can bevel a portion of said interior rim 910 between said interior rim 910 and said first face 918, and said second bevel 916 can bevel a portion of said interior rim 910 between said interior rim 910 and said second face 919. In one embodiment, said first pressure ring 208 can comprise a tubing aperture 920 comprising a portion of said tubing aperture 120. In one embodiment, said first pressure ring 208 can comprise a hinge pin aperture 930 comprising a portion of said hinge socket 130.

FIGS. 10A, 10B, 10C and 10D illustrate an elevated top view, an elevated side view, an elevated wireframe top view and an elevated detail side cross-section view of said second pressure ring 210. In one embodiment, said second pressure ring 210 can comprise a substantially round ring shape comprising an interior diameter 1002, an external diameter 1004 and a thickness 1005. In one embodiment, said second pressure ring 210 can comprise a one or more spray heads. In one embodiment, said one or more spray heads can comprise a first spray head 1006*a*, a second spray head 1006*b* and a third spray head 1006*c*. In one embodiment, said one or more spray heads can be arranged about said interior diameter 1002 on an interior rim 1007 of said second pressure ring 210. In one embodiment, said one or more spray heads can be replaceably attached and detached (that is selectively removed, reattached and/or replaced from) said one or more plates. In one embodiment, said second pressure ring 210 can comprise a one or more spray head fluid channels. In one embodiment, said one or more spray head fluid channels can comprise a first fluid channel 1008*a*, a second fluid channel 1008*b* and a third fluid channel 1008*c*. In one embodiment, said one or more spray head fluid channels can each comprise an internal threading. For example, in one embodiment, said first fluid channel 1008*a* can comprise a threading 1009*a*, said second fluid channel 1008*b* can comprise a threading 1009*b* and said third fluid channel 1008*c* can comprise a threading 1009*c*. In one embodiment, said one or more spray heads can attach to said one or more spray head fluid channels by screwing said one or more spray heads into said internal threading of said one or more spray head fluid channels. In one embodiment, said second pressure ring 210 can comprise a fluid dispersing ring 1010 arranged about said external diameter 1004 of said second pressure ring 210. In one embodiment, said one or more spray heads can attach said one or more spray head fluid channels and said one or more spray head fluid channels can attach to said fluid dispersing ring 1010. Accordingly, in one embodiment, said fluid dispersing ring 1010 can receive a fluid, deliver said fluid into said one or more spray head fluid channels and spray said fluid out of said one or more spray heads. In one embodiment, said fluid dispersing ring 1010 can comprise a width 1011. In one embodiment, said second pressure ring 210 can comprise an external rim 1012 about said external diameter 1004 of said second pressure ring 210. In one embodiment, said fluid dispersing ring 1010 can comprise a cut in said external rim 1012. In one embodiment, said second pressure ring 210 can comprise a first bevel 1014, a second bevel 1016, a first face 1018 and a second face 1019. In one embodiment, said first bevel 1014 can comprise a bevel between said external rim 1012 and said first face 1018, and said second bevel 1016 can comprise a bevel in said external rim 1012 between said external rim 1012 and said second face 1019. In one embodiment, said second pressure ring 210 can comprise a tubing aperture 1020 which can comprise a portion of said tubing aperture 120.

FIGS. 11A, 11B, 11C and 11D illustrate a perspective overview, an elevated top view, an elevated side view, and an elevated cross-section side view of said second outer plate 204. In one embodiment, said second outer plate 204 can comprise an external diameter 1102, an internal diameter 1104, a thickness 1106, a first face 1108, a second face 1110, a bevel 1112, a weld gap 1114, an interior rim 1116, an external rim 1118 and a tubing aperture 1120. In one embodiment, said bevel 1112 can bevel a portion of said interior rim 1116 between said interior rim 1116 and said second face 1110. In one embodiment, said weld gap 1114 can comprise a substantially round indention in said first face 1108 about said tubing aperture 1120. In one embodiment, said second outer plate 204 can comprise a substantially round plate having said tubing aperture 1120 about its center. In one embodiment, said second outer plate 204 can comprise a hinge pin aperture 1130 which can comprise a portion of said hinge socket 130. In one embodiment, said tubing aperture 1120 can comprise a portion of said tubing aperture 120.

Figure 12A:
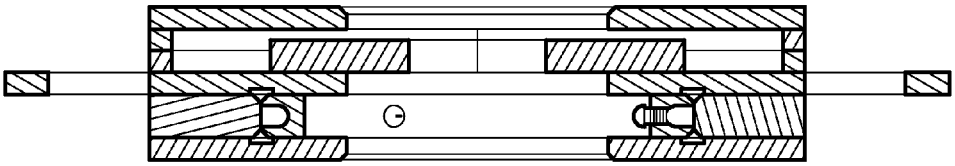
FIGS. 12A and 12B illustrate an elevated cross-section side view and an elevated cross-section top view of said tubing cleaning system.
Figure 12B:
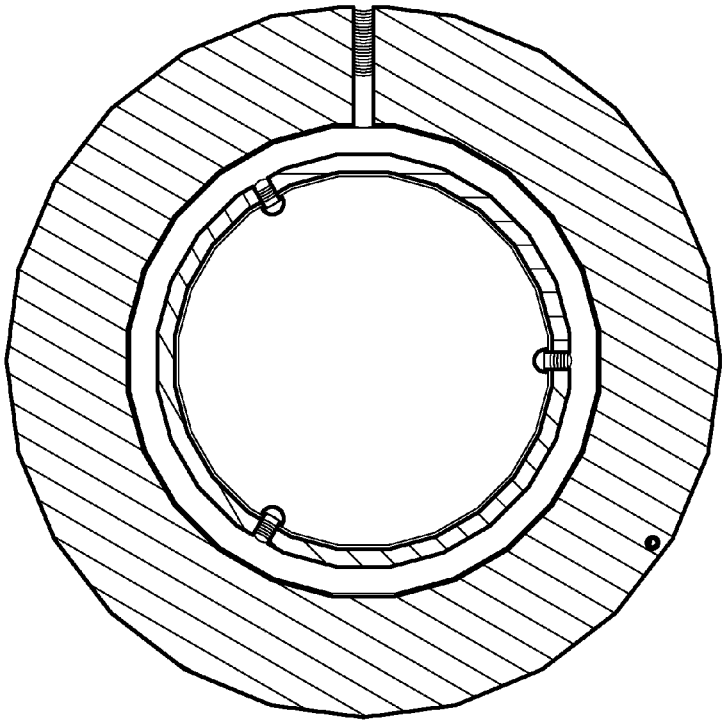

FIGS. 12A and 12B illustrate an elevated cross-section side view and an elevated cross-section top view of said tubing cleaning system 100.

Figure 13A:
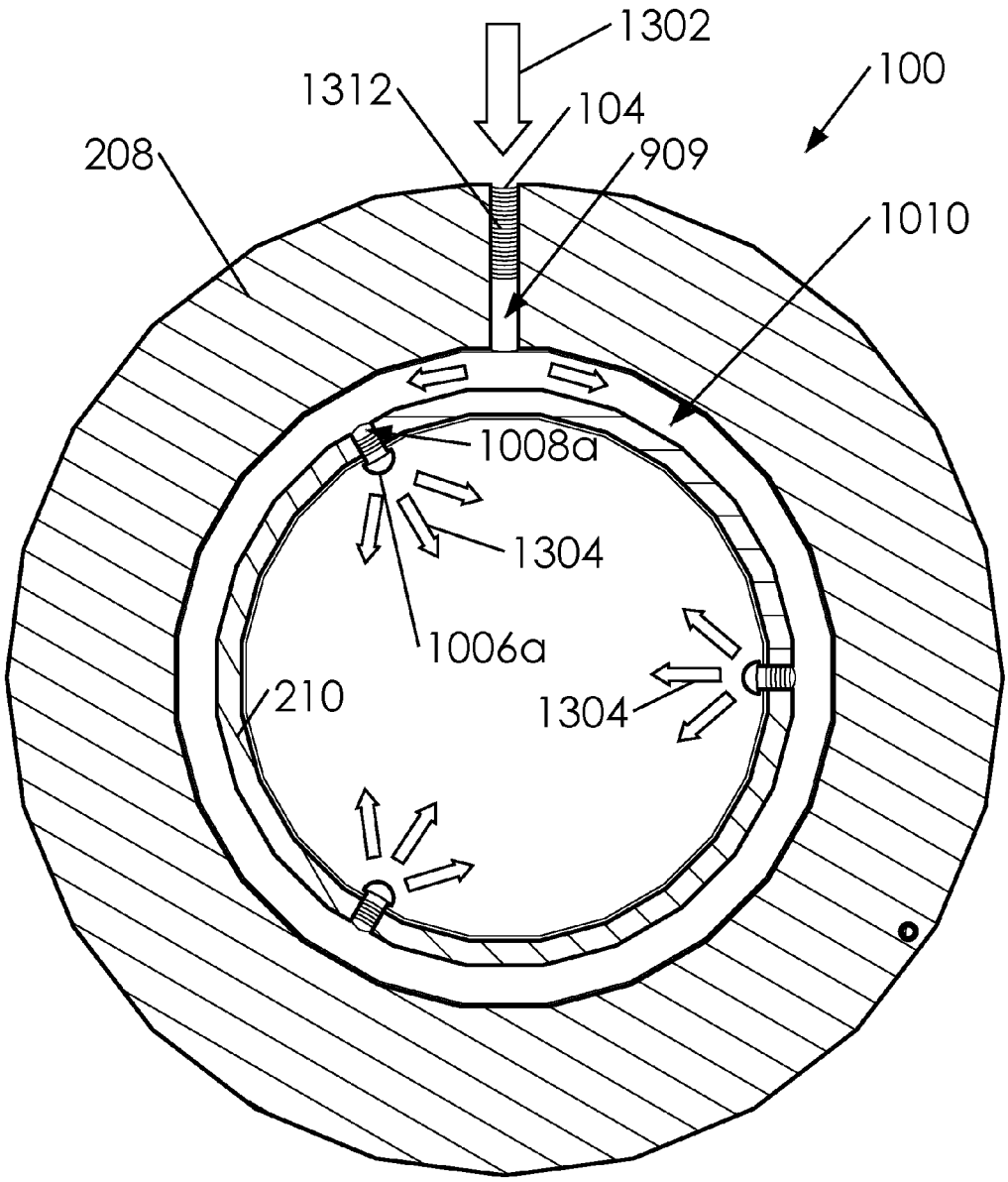
FIGS. 13A and 13B illustrate a fluid movement diagram on an elevated cross-section top view of said tubing cleaning system and an elevated view of said first pressure ring and said second pressure ring.
Figure 13B:
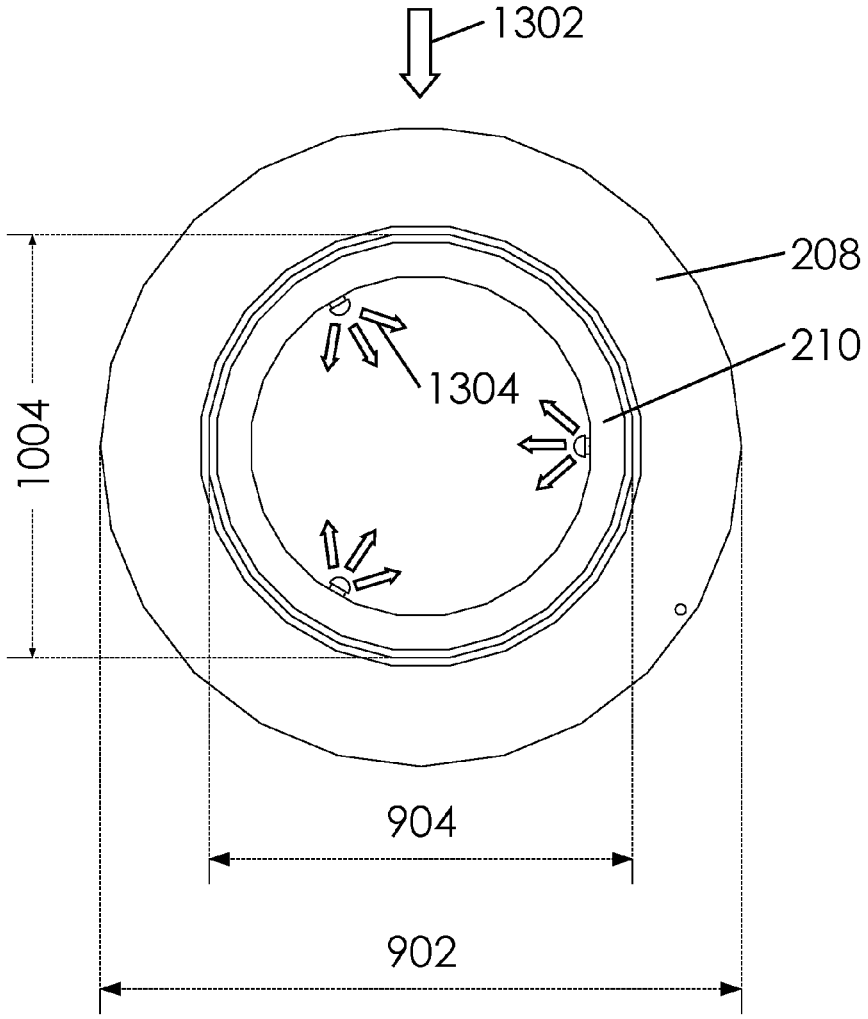

FIGS. 13A and 13B illustrate a fluid movement diagram on an elevated cross-section top view of said tubing cleaning system 100 and an elevated view of said first pressure ring 208 and said second pressure ring 210. In one embodiment, said tubing cleaning system 100 can receive a fluid stream 1302 at said fluid input 104. In one embodiment, said fluid stream 1302 can comprise water or another fluid. In one embodiment, said fluid stream 1302 can comprise a cleaning fluid used for cleaning tubing. In one embodiment, said tubing cleaning system 100 can: receive said fluid stream 1302 at said fluid input 104; and channel said fluid stream 1302 through said fluid channel 909, through said fluid dispersing ring 1010, through said one or more spray head fluid channels and out of said one or more spray heads as a sprayed fluid 1304. Thus, in one embodiment said tubing cleaning system 100 can receive said fluid stream 1302 and spray it within said tubing aperture 120. In one embodiment, said sprayed fluid 1304 can be sprayed within said tubing aperture 120 at a desired pressure. In one embodiment, said desired pressure can be adjusted by modifying said one or more spray heads and/or a pressure of said fluid stream 1302 prior to delivering said fluid stream 1302 to said fluid input 104.

In one embodiment, said second pressure ring 210 can fit within said first pressure ring 208. In one embodiment, said external diameter 1004 of said second pressure ring 210 can be substantially equal to said internal diameter 904 of said first pressure ring 208. Thus, in one embodiment said interior diameter 1002 of said second pressure ring 210 can press substantially against said external rim 912 of said first pressure ring 208. Accordingly, in one embodiment, said fluid channel 909 of said first pressure ring 208 can flow directly into said fluid dispersing ring 1010 of said second pressure ring 210.

In one embodiment, said tubing cleaning system 100 can deliver a wide range of pressures at said one or more spray heads. For example, in one embodiment, said one or more spray heads might deliver a pressure rating of 10,000 psi. In one embodiment, rating said tubing cleaning system 100 for high pressure spraying can comprise building said one or more plates out of a pressure vessel grade steel in a common configuration or a stainless steel for higher pressure ratings. Thus, in one embodiment, choosing a material to construct said tubing cleaning system 100 can effect a pressure rating of said tubing cleaning system 100. In another embodiment, said internal threading of said one or more spray head fluid channels and said internal threading 913 of said fluid channel 909 can be configured to accommodate a higher pressure rating of said tubing cleaning system 100.

Figure 14A:
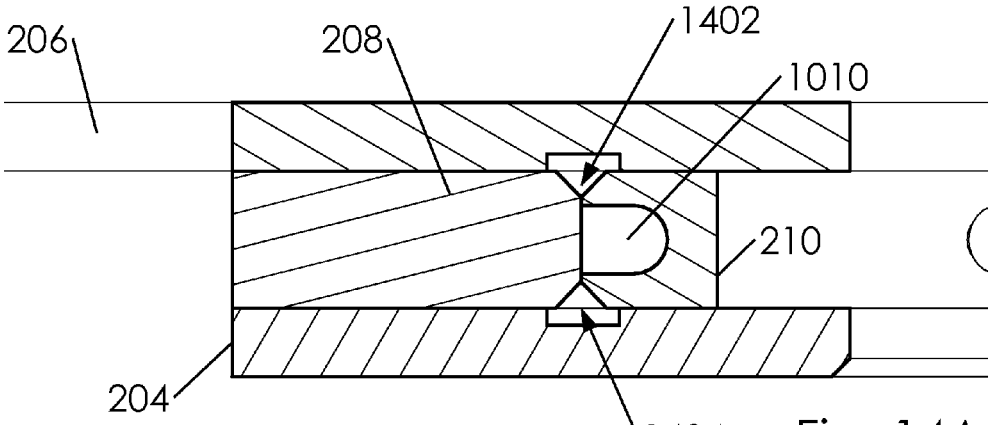
FIGS. 14A, 14B and 14C illustrate an elevated cross-section side view of said handle plate, said first pressure ring, said second pressure ring and said second outer plate; an elevated cross-section side view of said first pressure ring and said second pressure ring; and a detailed cross-section view of a first weld gap and a second weld gap.
Figure 14B:
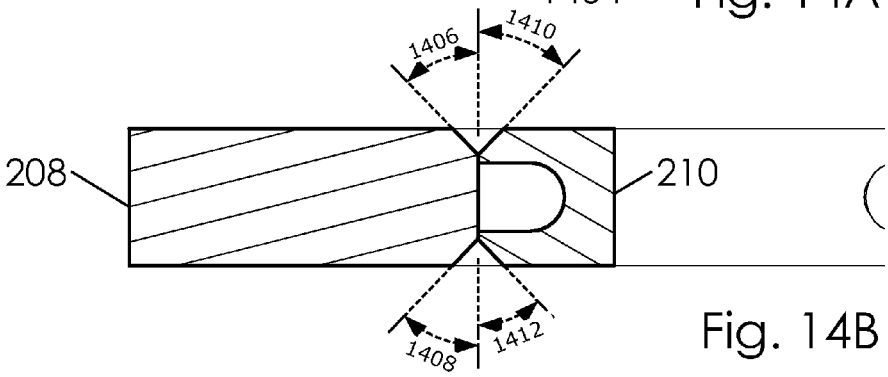
Figure 14C:
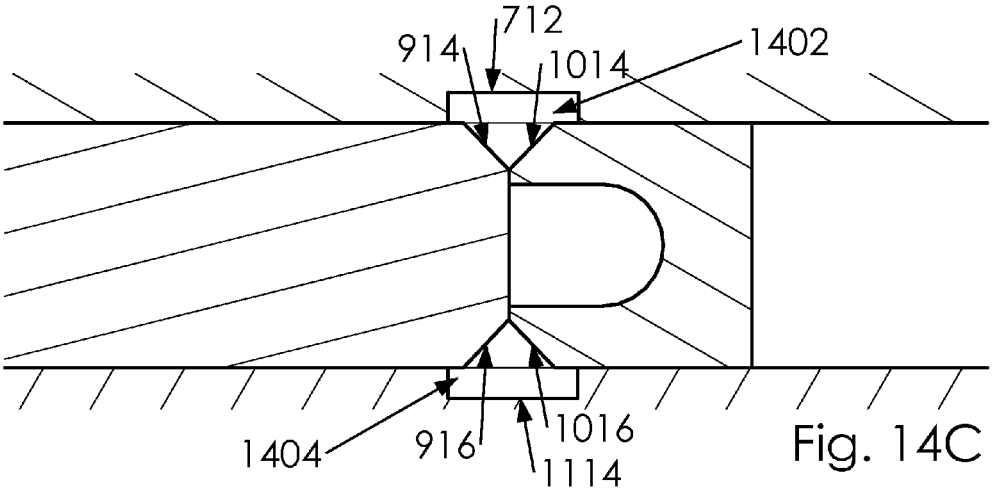

FIGS. 14A, 14B and 14C illustrate an elevated cross-section side view of said handle plate 206, said first pressure ring 208, said second pressure ring 210 and said second outer plate 204; an elevated cross-section side view of said first pressure ring 208 and said second pressure ring 210; and a detailed cross-section view of a first weld gap 1402 and a second weld gap 1404. In one embodiment, said tubing cleaning system 100 can comprise said first weld gap 1402 and said second weld gap 1404. In one embodiment, said first weld gap 1402 can comprise a space between said weld gap 712 in said handle plate 206, said first bevel 914 of said first pressure ring 208 and said first bevel 1014 of said second pressure ring 210. In one embodiment, said second weld gap 1404 can comprise a space between said weld gap 1114 in said second outer plate 204, said second bevel 1016 in said second pressure ring 210, and said second bevel 916 of said first pressure ring 208. In one embodiment, said first bevel 914 of said first pressure ring 208 and said first bevel 1014 of said second pressure ring 210 can form a "V" shape capable of receiving a weld between said first pressure ring 208 and said second pressure ring 210. In one embodiment, said second bevel 1016 in said second pressure ring 210 and said second bevel 916 of said first pressure ring 208 can form a "V" shape capable of receiving a weld between said first pressure ring 208 and said second pressure ring 210. In one embodiment, welding said one or more plates to one another can comprise melting said one or more plates together and adding a filler material (as is common in welding). In one embodiment, said tubing cleaning system 100 must meet one or more regulatory standards in order to be used in industry. For example, in one embodiment, a regulatory standard can comprise a "code weld" which requires that said filler material not be removed after welding together said one or more plates. Accordingly, in one embodiment, a first code weld can be applied in said first weld gap 1402 and a second code weld can be applied in said second weld gap 1404. In one embodiment, said first code weld and said second code weld can leave behind a first filler material (not illustrated) in said first weld gap 1402 and a second filler material (not illustrated) in said second weld gap 1404, respectively; wherein, said weld gap 712 in said first weld gap 1402 and said weld gap 1114 in said second weld gap 1404 can provide ample space for said first filler material and said second filler material. In one embodiment, said first bevel 914 can comprise an offset angle 1406, said second bevel 916 can comprise an offset angle 1408, said first bevel 1014 can comprise an offset angle 1410, and said second bevel 1016 can comprise an offset angle 1412. In one embodiment, said offset angles 1406-1412 can comprise a 45 degree angle; wherein, said "V" shapes (as described above) can comprise a 90 degree angle.

In one embodiment, said handle plate 206 can be welded to said first pressure ring 208 with a weld 1422. In one embodiment, said second outer plate 204 can be welded to said first pressure ring 208 with a weld 1424. In one embodiment, said weld 1422 and said weld 1424 can wrap substantially around a perimeter of said one or more plates.

Figure 15A:
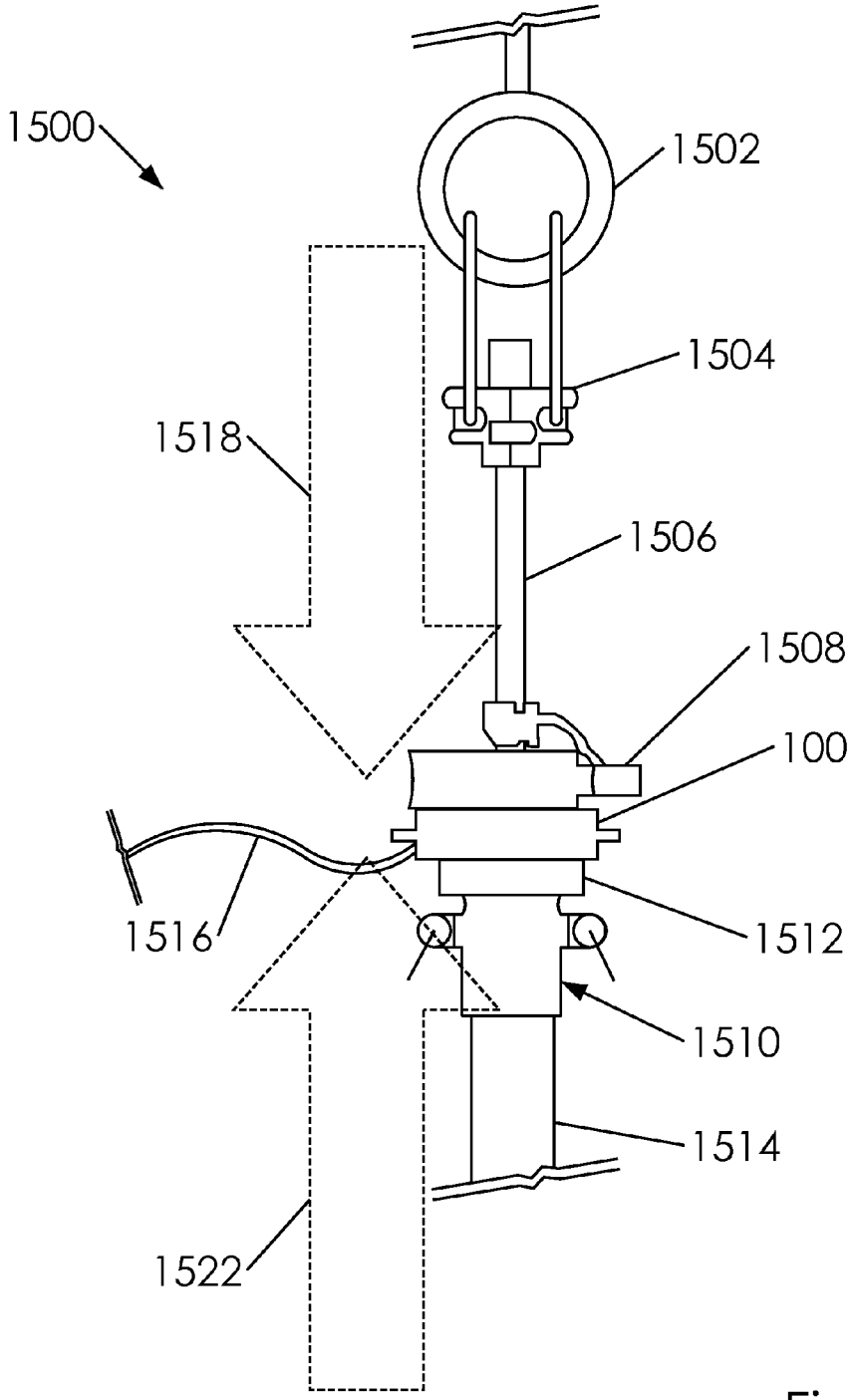
FIG. 15A illustrates an elevated side view of a tubing removal assembly with said tubing cleaning system.

FIG. 15A illustrates an elevated side view of a tubing removal assembly 1500 with said tubing cleaning system 100. In one embodiment, said tubing removal assembly 1500 can comprise a one or more blocks 1502, a one or more elevators 1504, a tubing 1506, an air slips 1508, a wellhead 1510 having a cap 1512, and a casing 1514. In one embodiment, said tubing cleaning system 100 can comprise a hose 1516. In one embodiment, said hose 1516 is capable of delivering said fluid stream 1302 to said tubing cleaning system 100. In one embodiment, said hose 1516 can attach to said fluid input 104 and can attach to said internal threading 913 of said fluid channel 909. In one embodiment, using said tubing cleaning system 100 in said tubing removal assembly 1500 can comprise withstanding a one or more forces such as a downward force 1518 and an upward force 1522. In one embodiment, using said tubing cleaning system 100 in line with said tubing removal assembly 1500 and bearing said one or more forces can comprise a distinctive feature of said tubing cleaning system 100. In one embodiment, said one or more plates are stacked on one another. In one embodiment, said one or more fluid channels in said one or more plates are protected by said one or more plates. In one embodiment, each of said one or more plates are individual and collectively capable of withstanding said downward force 1518 and/or said upward force 1522.

Figure 15B:
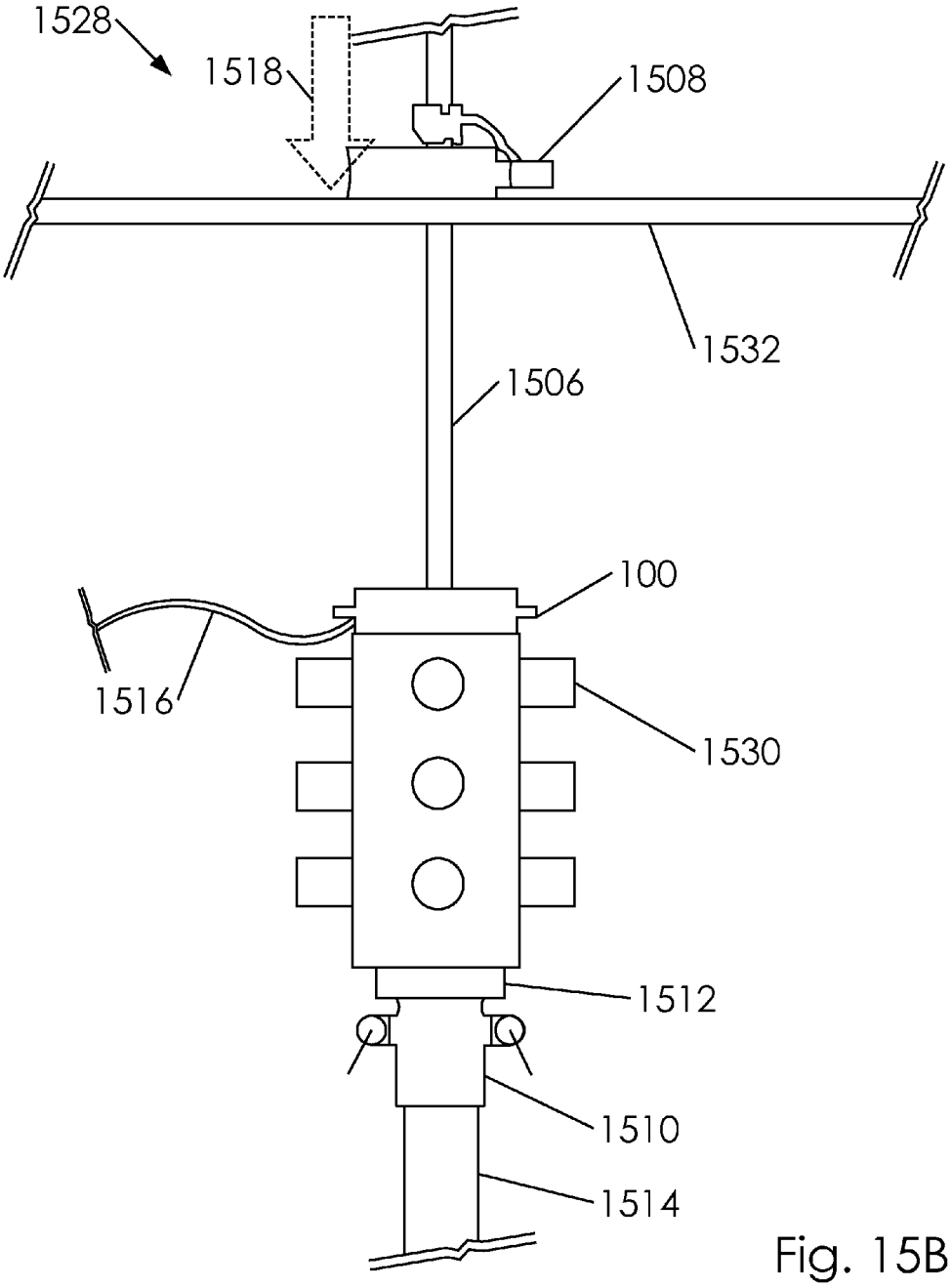
FIG. 15B illustrates an elevated side view of a tubing removal assembly with said tubing cleaning system.

FIG. 15B illustrates an elevated side view of a tubing removal assembly 1528 with said tubing cleaning system 100. In one embodiment, said tubing cleaning system 100 can be used with said tubing removal assembly 1528. In one embodiment, said tubing removal assembly 1528 can comprise a system for removing said tubing 1506 from said casing 1514 with the added benefit of a blowout preventer 1530 and a substructure 1532; wherein, a portion of said downward force 1518 can be isolated and held up by said substructure 1532. In one embodiment, said tubing cleaning system 100 can attach on top of said blowout preventer 1530 which is, in turn, attached on top of said wellhead 1510. Thus, in one embodiment said tubing cleaning system 100 can be used with or without said upward force 1522 and downward force 1518 pressed into itself.

Figure 16A:
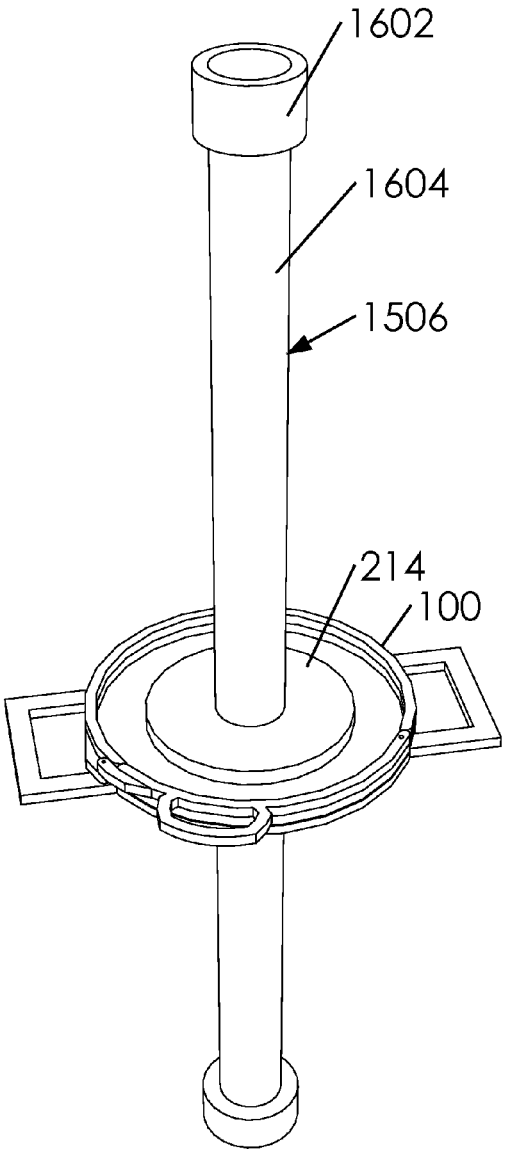
FIGS. 16A, 16B and 16C illustrate a perspective overview of said tubing with a portion of said tubing cleaning system without said first outer plate; a perspective overview of said tubing with a cross-section view of said tubing cleaning system; and an elevated side view of said tubing with a cross-section view of said tubing cleaning system.
Figure 16B:
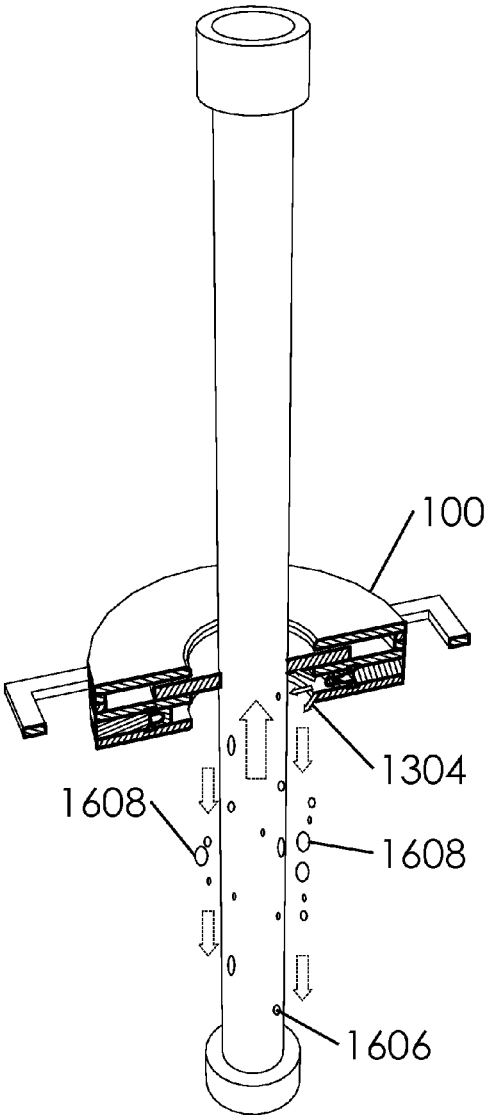
Figure 16C:
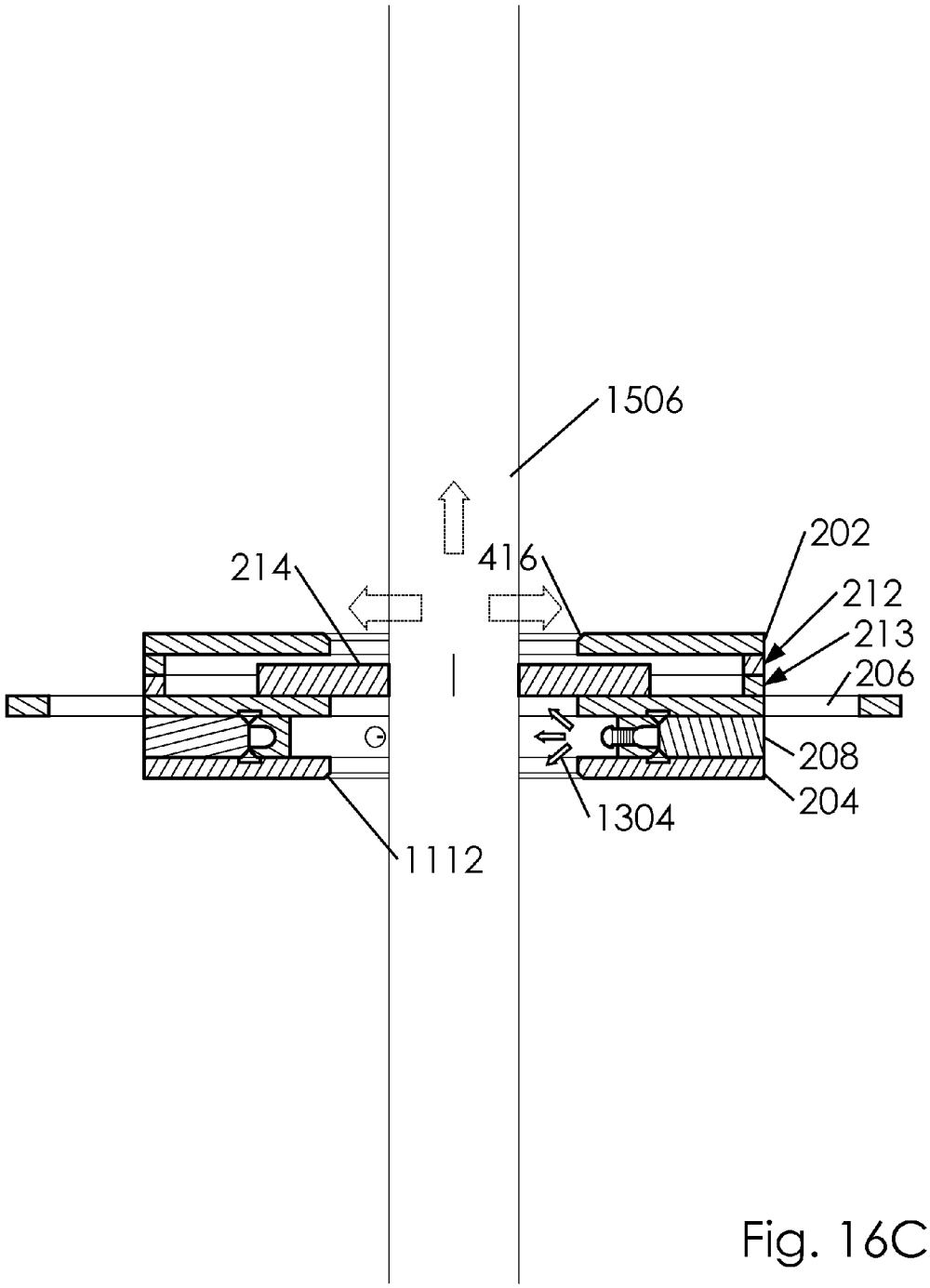

FIGS. 16A, 16B and 16C illustrate a perspective overview of said tubing 1506 with a portion of said tubing cleaning system 100 without said first outer plate 202; a perspective overview of said tubing 1506 with a cross-section view of said tubing cleaning system 100; and an elevated side view of said tubing 1506 with a cross-section view of said tubing cleaning system 100. In one embodiment, said tubing 1506 can comprise a one or more collar portions 1602 and a body portion 1604. In one embodiment (but not in all embodiments), said body portion 1604 can comprise a 2⅜" diameter and said one or more collar portions 1602 can comprise a 3 1/16" diameter. In another embodiment, said body portion 1604 can comprise 2⅞" and/or said tubing 1506 can comprise J55 type tubing.

In one embodiment, said wiping rubber 214 can comprise said internal diameter 334 (illustrated above). In one embodiment, said internal diameter 334 of said wiping rubber 214 can fit snugly around said body portion 1604 and can also stretch to accommodate said one or more collar portions 1602. In one embodiment, said tubing cleaning system 100 can be used to clean said tubing 1506 as it is removed from said tubing removal assembly 1500 or said tubing removal assembly 1528. In one embodiment, said tubing cleaning system 100 can clean said tubing 1506 by: spraying a portion of said tubing 1506 as it passes through said second pressure ring 210 with said one or more spray heads; and wiping a portion of said tubing 1506 with said wiping rubber 214. In one embodiment, said tubing 1506 can accumulate a residue 1606 while in use. In one embodiment, removing said residue 1606 can comprise a useful objective of said tubing cleaning system 100 so as prepare said tubing 1506 for future use, transport and/or other tasks known in the art. In one embodiment, said tubing cleaning system 100 can be installed into said tubing removal assembly 1500 and bear said one or more forces. In one embodiment, removing a portion of said residue 1606 from said tubing 1506 with said tubing cleaning system 100 can comprise: spraying said residue 1606 with said one or more spray heads, wiping said tubing 1506 with said wiping rubber 214, and releasing a debris 1608 below said tubing cleaning system 100. In one embodiment, said debris 1608 can fall back down said casing 1514. In one embodiment, said debris 1608 can comprise a portion of said residue 1606 and a portion of said sprayed fluid 1304. In one embodiment, said tubing 1506 can be pulled passed said tubing cleaning system 100 as it is removed from said tubing removal assembly 1500.

In one embodiment, said tubing 1506 and said wiping rubber 214 can move horizontally relative to said one or more plates and said one or more spacers of said tubing cleaning system 100. In one embodiment, said tubing aperture 120 of said tubing cleaning system 100 can comprise a one or more beveled edges at a first end and a second end of said tubing aperture 120 comprising said beveled edge 416 of said first outer plate 202 and said bevel 1112 of said second outer plate 204. In one embodiment, said one or more beveled edges of said tubing aperture 120 can protect said tubing 1506 as it passes into and out of said tubing aperture 120 by eliminating a sharpened edge when said tubing 1506 is in transition relative to said tubing cleaning system 100.

In one embodiment, said one or more plates can comprise a gap 1632 between said handle plate 206 and said second outer plate 204. In one embodiment, a portion of said one or more spray heads can be protected within said gap 1632. In one embodiment, said tubing 1506 can move horizontally within said tubing aperture 120 and can possibly hit a portion of said one or more plates but said one or more spray heads can remain protected within said gap 1632.

Figure 17:
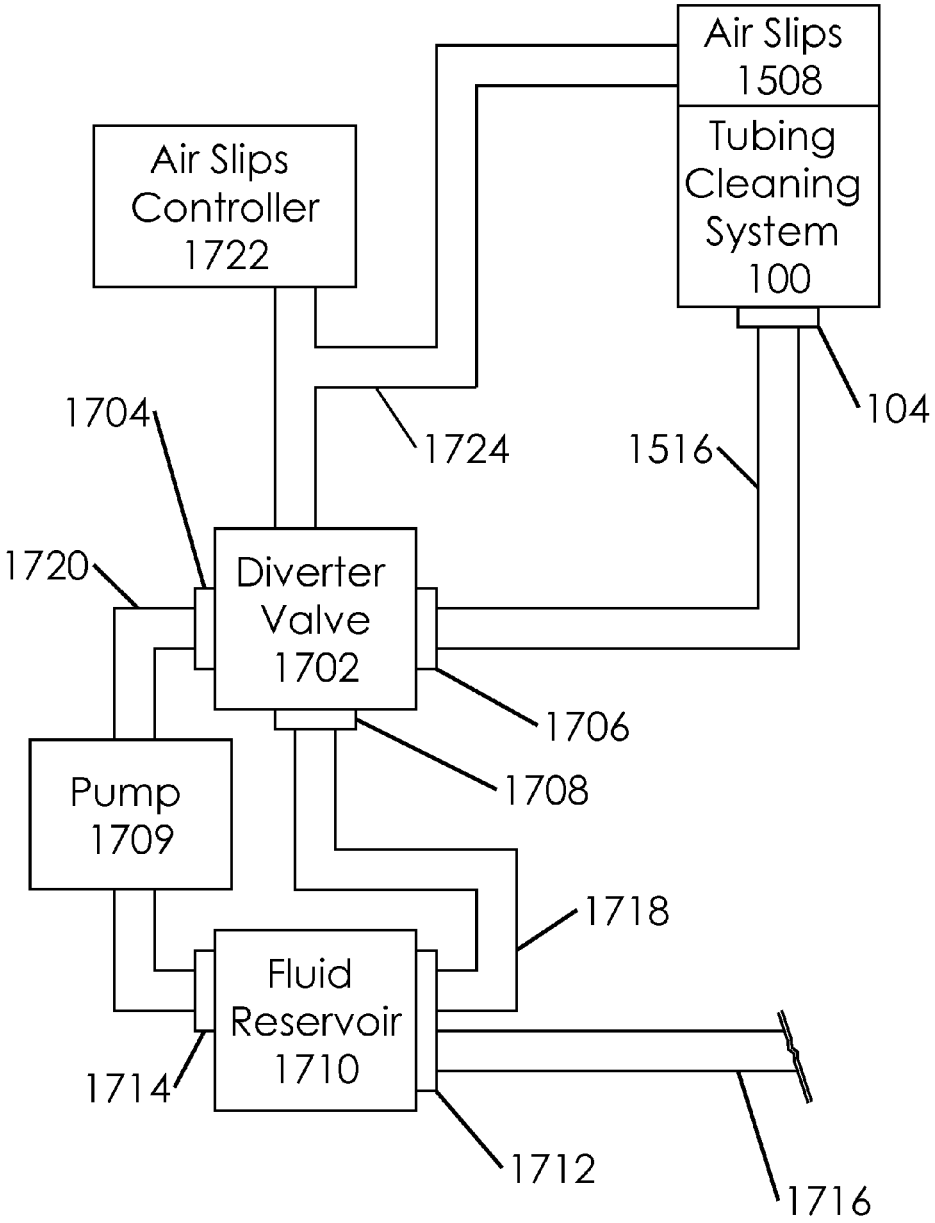
FIG. 17 illustrates a diagram representing said tubing cleaning system, a diverter valve, a pump, a fluid reservoir, an air slips controller and said air slips.

FIG. 17 illustrates a diagram representing said tubing cleaning system 100, a diverter valve 1702, a pump 1709, a fluid reservoir 1710, an air slips controller 1722 and said air slips 1508. In one embodiment, said diverter valve 1702 can comprise an input 1704, a first output 1706 and a second output 1708. In one embodiment, said pump 1709 can pump said fluid from said fluid reservoir 1710 to said diverter valve

1702. In one embodiment, said fluid reservoir 1710 can comprise an input 1712 and an output 1714. In one embodiment, a fluid supply line 1716 can fill said fluid reservoir 1710 with said fluid. In one embodiment, said fluid supply line 1716 can be selectively attached to a fluid source so as to replenish said fluid in said fluid reservoir 1710. In one embodiment, said fluid can be transferred through said output 1714 and from said fluid reservoir 1710 through a fluid supply line 1720 to said input 1704. In one embodiment, said diverter valve 1702 can determine whether said fluid goes through a first output 1706 through said hose 1516 and to said tubing cleaning system 100 or through said second output 1708 and back to said fluid reservoir 1710 through a diverted fluid line 1718.

In one embodiment, said air slips controller 1722 can engage and disengage said air slips 1508 by pressurizing an airline 1724. In one embodiment, said diverter valve 1702 can be operated according to when said air slips 1508 are operated. For example, in one embodiment, when said air slips 1508 are disengaged, said airline 1724 can be routed through an air actuator that changes the position of a three way valve (inside of said diverter valve 1702) and thereby routing said fluid to said tubing cleaning system 100. Conversely, in one embodiment, when said air slips 1508 are engaged said fluid can be routed back to said fluid reservoir 1710. In one embodiment, said diverter valve 1702 can comprise an air activated diverter valve, as is known in the art.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A tubing cleaning system comprising:

a body portion comprising two or more plates, a tubing aperture through said two or more plates, a one or more spray heads arranged within said tubing aperture, a fluid input, a one or more fluid channels cut into said two or more plates between said fluid input and said one or more spray heads, a wiping rubber having a tubing aperture, a one or more spacers, and a cavity; wherein, said cavity is between said one or more spacers and said two or more plates;

said wiping rubber is housed within said cavity;

said one or more spacers comprising a gate;

a hinge socket in a portion of said two or more plates;

a hinge pin aperture in a portion of said one or more spacers;

a hinge pin through said hinge socket and said hinge pin aperture;

said gate pivots on said hinge pin;

two or more latch adapters having a first latch adapter and a second latch adapter;

said first latch adapter attaches to said gate;

said second latch adapter attaches to said one or more spacers;

said two or more latch adapters are capable of selectively attaching and detaching from one another;

said gate is capable of opening to an open-configuration with said two or more latch adapters detached from one another, and closing to a closed-configuration with said two or more latch adapters attached to one another;

beveled edges at a first end and a second end of said tubing aperture;

said two or more plates comprise a first outer plate, a first pressure ring, a second pressure ring, and a second outer plate;

said first pressure ring comprising a ring shape having an external rim, and an interior rim and a tubing aperture;

said first pressure ring comprising an external diameter at said external rim of said first pressure ring and an internal diameter about said interior rim of said first pressure ring;

said first pressure ring comprise said fluid input;

said second pressure ring comprising a ring shape having a tubing aperture, an external rim, and an interior rim;

said second pressure ring having an external diameter at said external rim and an internal diameter of said second pressure ring at said interior rim of said second pressure ring;

said second pressure ring comprises said one or more spray heads;

said external diameter of said second pressure ring is equal to or less than said internal diameter of said first pressure ring;

said second pressure ring fits within said tubing aperture of said first pressure ring;

said one or more fluid channels between said fluid input and said one or more spray heads are contained within said first pressure ring and said second pressure ring between said fluid input and said one or more spray heads;

said second pressure ring comprise a fluid dispersing ring about said external rim in said second pressure ring;

said fluid dispersing ring is partially enclosed by said first pressure ring when said second pressure ring is inserted into said tubing aperture of said first pressure ring;

said second pressure ring further comprises a one or more spray head fluid channels between said fluid dispersing ring and said one or more spray heads;

said first pressure ring comprises a fluid channel between said fluid input at said external rim of said first pressure ring and a fluid output at said interior rim of said first pressure ring;

said one or more fluid channels of said tubing cleaning system comprise said fluid channel in said first pressure ring, and said fluid dispersing ring and said one or more spray head fluid channels of said second pressure ring;

said one or more spray heads are replaceably attached and detached from an internal threading in said two or more plates;

said two or more plates further comprise a handle plate having a body portion, a tubing aperture, a first handle and a second handle;

said two or more plates comprise a durable material capable of holding downward force and an upward force at a tubing removal assembly at a wellhead;

said two or more plates of said tubing cleaning system are stacked one upon the other, said one or more fluid channels are protected by said two or more plates, and each of said two or more plates are individual and collectively capable of withstanding said downward force and said upward force;

said two or more plates are welded together; and said two or more plates comprise steel.

2. A tubing cleaning system comprising:

a body portion comprising two or more plates, a tubing aperture through said two or more plates, a one or more spray heads arranged within said tubing aperture, a fluid input, a one or more fluid channels, a wiping rubber having a tubing aperture, a one or more spacers and a cavity, and a hinge socket; wherein, said one or more fluid channels are cut into said two or more plates between said fluid input and said one or more spray heads;

said cavity is between said one or more spacers and said two or more plates;

said wiping rubber is housed within said cavity;

said one or more spacers comprising a gate;

said hinge socket in a portion of said two or more plates and said one or more spacers;

a hinge pin through said hinge socket; and said gate pivots on said hinge pin.

3. The tubing cleaning system of claim 2 further comprising, two or more latch adapters having a first latch adapter and a second latch adapter;

said first latch adapter attaches to said gate;

said second latch adapter attaches to said one or more spacers;

said two or more latch adapters are configured to selectively attaching and detaching from one another; and said gate is configured for opening to an open-configuration with said two or more latch adapters detached from one another, and closing to a closed-configuration with said two or more latch adapters attached to one another.

4. The tubing cleaning system of claim 2 wherein, said one or more spray heads are replaceably attached and detached from an internal threading in said two or more plates.

5. The tubing cleaning system of claim 2 wherein, said two or more plates further comprise a handle plate having a body portion, a tubing aperture, a first handle and a second handle.

6. The tubing cleaning system of claim 2 wherein, said two or more plates comprise a durable material configured for holding downward force and a upward force at a tubing removal assembly at a wellhead; and further wherein, said two or more plates of said tubing cleaning system are stacked one upon the other, said one or more fluid channels are protected by said two or more plates, and each of said two or more plates are individual and collectively configured for withstanding said downward force and said upward force.

7. The tubing cleaning system of claim 2 wherein, said two or more plates are welded together.

8. The tubing cleaning system of claim 2 wherein, said two or more plates comprise steel.

9. A method of using a tubing cleaning system comprising:

attaching said tubing cleaning system having a tubing aperture to a portion of a tubing removal assembly at a wellhead;

removing a portion of a tubing from a casing at said wellhead and sliding said portion of said tubing through said tubing aperture;

attaching a hose to said tubing cleaning system;

supplying a fluid to said tubing cleaning system through said hose;

channeling said fluid through a one or more fluid channels within said tubing cleaning system;

spraying a fluid at said tubing with a one or more spray heads;

supporting a one or more forces pressing into said tubing cleaning system;

selectively channeling said fluid to said tubing cleaning system or a fluid reservoir with a diverter valve; and wherein, said tubing cleaning system comprises a body portion comprising two or more plates, said tubing aperture through said two or more plates, said one or more spray heads arranged within said tubing aperture, a fluid input, and said one or more fluid channels cut into said two or more plates between said fluid input and said one or more spray heads.

10. The method of using a tubing cleaning system of claim 9 further comprising:

containing a wiping rubber in a cavity between said two or more plates;

wiping a portion of said tubing with said wiping rubber; and wherein, said wiping rubber comprises a tubing aperture having an internal diameter equal to an exterior diameter of said tubing.

11. The method of using a tubing cleaning system of claim 9 further comprising:

welding said two or more plates together.

12. The method of using a tubing cleaning system of claim 9 further comprising:

directing said fluid to said tubing cleaning system when an air slips are disengaged, and diverting said fluid to a fluid reservoir when said air slips are engaged.

13. A tubing cleaning system comprising:

a body portion comprising two or more plates;

a tubing aperture through said two or more plates;

a one or more spray heads arranged within said tubing aperture;

a fluid input;

a one or more fluid channels cut into said two or more plates between said fluid input and said one or more spray heads; and beveled edges at a first end and a second end of said tubing aperture.

14. A tubing cleaning system comprising:

a body portion comprising a two or more plates;

a tubing aperture through said two or more plates;

a one or more spray heads arranged within said tubing aperture;

a fluid input;

a one or more fluid channels cut into said two or more plates between said fluid input and said one or more spray heads; and said two or more plates comprise a first outer plate, a first pressure ring, a second pressure ring, and a second outer plate;

said first pressure ring comprising a ring shape having an external rim, and an interior rim and a tubing aperture;

said first pressure ring comprising an external diameter at said external rim of said first pressure ring and an internal diameter about said interior rim of said first pressure ring;

said first pressure ring comprise said fluid input;

said second pressure ring comprising a ring shape having a tubing aperture, an external rim, and an interior rim;

said second pressure ring having an external diameter at said external rim and an internal diameter of said second pressure ring at said interior rim of said second pressure ring;

said second pressure ring comprises said one or more spray heads;

said external diameter of said second pressure ring is equal to or less than said internal diameter of said first pressure ring;

said second pressure ring fits within said tubing aperture of said first pressure ring; and said one or more fluid channels between said fluid input and said one or more spray heads are contained within said first pressure ring and said second pressure ring between said fluid input and said one or more spray heads.

15. The tubing cleaning system of claim 14 wherein, said second pressure ring comprise a fluid dispersing ring about said external rim in said second pressure ring;

said fluid dispersing ring is partially enclosed by said first pressure ring when said second pressure ring is inserted into said tubing aperture of said first pressure ring;

said second pressure ring further comprises a one or more spray head fluid channels between said fluid dispersing ring and said one or more spray heads;

said first pressure ring comprises a fluid channel between said fluid input at said external rim of said first pressure ring and a fluid output at said interior rim of said first pressure ring; and said one or more fluid channels of said tubing cleaning system comprise said fluid channel in said first pressure ring, and said fluid dispersing ring and said one or more spray head fluid channels of said second pressure ring.

* * * * *